US006966827B2

(12) United States Patent
Perkitny

(10) Patent No.: US 6,966,827 B2
(45) Date of Patent: Nov. 22, 2005

(54) COIN BANK

(75) Inventor: Jerzy Perkitny, Lakewood, OH (US)

(73) Assignee: Mag-Nif Incorporated, Mentor, OH (US)

( * ) Notice: Subject to any disclaimer, the term of this patent is extended or adjusted under 35 U.S.C. 154(b) by 263 days.

(21) Appl. No.: 10/633,378

(22) Filed: Aug. 1, 2003

(65) Prior Publication Data

US 2004/0097181 A1 May 20, 2004

Related U.S. Application Data

(63) Continuation-in-part of application No. 09/879,732, filed on Jun. 12, 2001, now Pat. No. 6,638,157.

(51) Int. Cl.[7] ..... G07D 3/00
(52) U.S. Cl. ..... 453/3
(58) Field of Search ..... 453/3, 5, 9, 63; 194/350; 446/8; 232/4 D, 4 R

(56) References Cited

U.S. PATENT DOCUMENTS

| | | | | |
|---|---|---|---|---|
| 2,886,045 A | * | 5/1959 | Brown et al. | 453/5 |
| 3,002,601 A | * | 10/1961 | Reis | 194/200 |
| 3,242,931 A | | 3/1966 | Wandrey | |
| 4,095,607 A | | 6/1978 | Newton et al. | |
| 4,396,029 A | | 8/1983 | Anderson | |
| 4,511,341 A | | 4/1985 | Spirk, Jr. et al. | |
| 4,593,709 A | | 6/1986 | Duplessy | |
| 4,987,990 A | | 1/1991 | Perkitny | |
| 4,995,848 A | | 2/1991 | Goh | |
| 5,474,496 A | | 12/1995 | Perkitny | |
| 5,827,117 A | | 10/1998 | Naas | |
| 5,902,178 A | * | 5/1999 | Perkitny | 453/9 |
| 5,976,006 A | | 11/1999 | Snyder | |
| 6,099,401 A | | 8/2000 | Perkitny | |
| 6,165,063 A | | 12/2000 | Perkitny | |
| 6,210,264 B1 | | 4/2001 | Richardson | |

FOREIGN PATENT DOCUMENTS

| | | |
|---|---|---|
| GB | 2 130 779 | 6/1984 |
| GB | 2 138 192 | 10/1984 |

OTHER PUBLICATIONS

Mag-Nif Brochure, "Mag-Nif makes it in the U.S.A. !", 1999, cover page, pp. 1-16 and back cover.

* cited by examiner

*Primary Examiner*—Donald P. Walsh
*Assistant Examiner*—Mark J. Beauchaine
(74) *Attorney, Agent, or Firm*—Fay, Sharpe, Fagan, Minnich & McKee, LLP

(57) ABSTRACT

A coin bank includes a housing having a coin receiving area for receiving unsorted coins, a coin sorting area for sorting the unsorted coins, and a coin storage area for storing sorted coins. The coin storage area includes a drawer slidably mounted in the housing. It can also include a coin tube support mounted in the drawer for movement between an inclined position when the drawer is fully retracted in the housing and an upright position when the drawer is fully extended from the housing. A semi-automatic opening device displaces the drawer from its retracted position to its extended position. In one embodiment, a battery operated drawer drive unit is releasably coupled with the housing and is selectively operable to displace the drawer between the retracted and extended positions thereof. The releasable coupling can include a lever pivotal to disengage from the drive unit, thus releasing the drawer for manual displacement between the retracted and extended positions thereof.

30 Claims, 19 Drawing Sheets

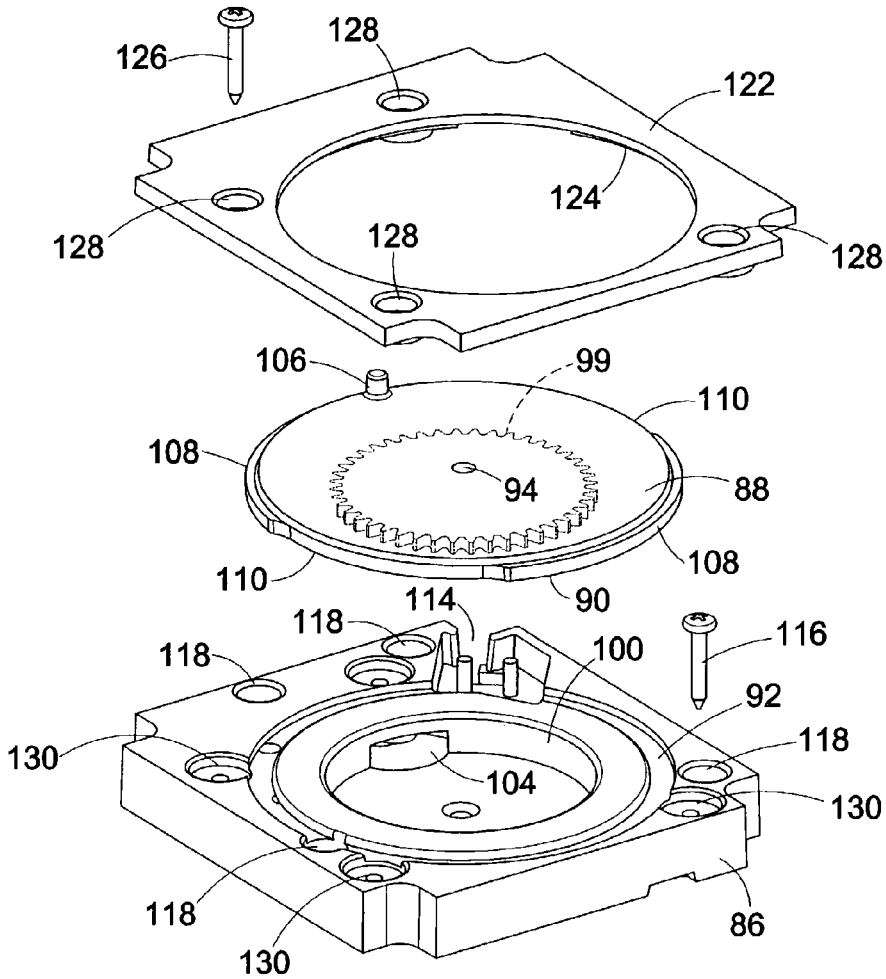
FIG. 4
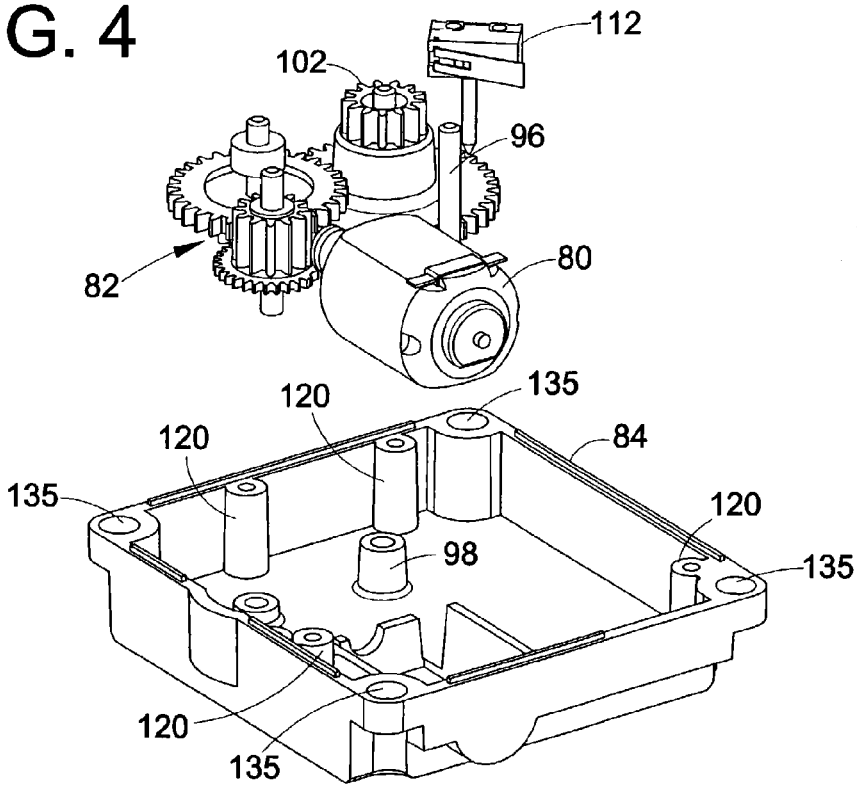

140
140
140
168
174
166
176
176
176
176
174
160
168
174
164
166
164
165
172
142
138
161
172
172
158
152
164
150
144
154
148
172
136
180
184
178
164
156
162
146
186
188
184
188
144
146
156
186
184
188

COIN BANK

This application is a continuation-in-part of application Ser. No. 09/879,732 filed Jun. 12, 2001, now U.S. Pat. No. 6,638,157.

BACKGROUND OF THE INVENTION

The present invention relates to the art of coin banks and, more particularly, to a coin bank having a coin storage area including a coin holding unit selectively displaceable between retracted and extended positions relative to the coin bank housing.

The present invention finds particular utility in connection with a coin bank structured similar to that illustrated and described in the above-mentioned co-pending application, the subject matter of which is incorporated herein by reference in its entirety. While the invention will be described herein in conjunction with such a coin bank structure, it will be understood and appreciated that the invention is applicable to other coin bank structures including a coin storage unit which is selectively displaceable between retracted and extended positions relative to a coin bank housing.

Basically, the coin bank illustrated and described in the aforementioned co-pending application comprises a housing including a coin receiving area for receiving unsorted coins, a coin sorting assembly in the housing beneath the coin receiving area for separating coins based on their denomination, and a coin storage area beneath the sorting assembly for storing sorted coins. The storage area comprises a drawer slidably mounted in the housing and a plurality of coin tubes supported in the drawer for displacement therewith and for pivotal displacement relative thereto between inclined and generally upright positions. The drawer is manually displaceable between retracted and extended positions relative to the housing, and the coin tubes are in the inclined position for receiving sorted coins when the drawer is in the retracted position and are upright to facilitate removing one or more of the coin tubes when the drawer is in the extended position thereof.

While the sliding drawer serves its intended function in displacing the coin tubes between a retracted coin receiving position and an extended access position relative to the housing, manual displacement of the drawer is inconvenient and can be somewhat cumbersome. In this respect, a person must hold the housing with one hand while pulling the drawer from the retracted to the extended position and while pushing the drawer from the extended to the retracted position. Moreover, if the pulling or pushing force is imposed laterally of the linear path of movement in the directions of extension and retraction, the drawer and housing will frictionally interengage and, depending on the degree of side thrust, possibly make the relative displacement between the drawer and housing more difficult. Furthermore, while the drawer and housing interengage in the retracted and extended positions of the drawer to limit the relative displacement therebetween, manual displacement of the drawer is without any control of the speed of movement whereby displacement of the drawer can result in impacting between the component parts in the extreme positions of the drawer which, over a period of time, can result in excessive wear and/or damage to the parts.

SUMMARY OF THE INVENTION

In accordance with the present invention, an improved coin bank is provided by which the foregoing and other disadvantages encountered in connection with the operation of previously available coin bank structures are minimized and/or overcome. According to one aspect of the present invention, a coin bank comprises a housing having a coin receiving area, a coin sorting area and a coin storage area for storing sorted coins. The coin storage area includes a drawer displaceable relative to the housing between retracted and extended positions. A semi-automatic opening device is provided for displacing the drawer from the retracted position to the extended position.

In accordance with another aspect of the present invention, the coin bank comprises a housing having a coin receiving area, a coin sorting area and a coin storage area for storing sorted coins. The coin storage area includes a drawer removably mounted in the housing, a drive unit mounted on the drawer for displacement therewith and a coupling between the drive unit and the housing and interengaging with the drive unit for operation thereof to displace the drawer between a retracted position and an extended position.

In accordance with a further aspect of the present invention, a coin bank comprises a housing having a coin receiving area, a coin sorting area and a coin storage area for storing sorted coins. The coin storage area comprises a coin tube support displaceable between retracted and extended positions relative to the housing. A plurality of coin tubes are selectively held on the coin tube support for holding sorted coins. A semi-automatic opening device is positioned between the housing and the coin tube support for selectively displacing the coin tube support from a retracted position to an extended position.

According to a yet further aspect of the present invention, a coin bank comprises a housing having a coin receiving area, a coin sorting area, and a coin storage area for storing sorted coins. A coin support is provided for holding sorted coins and a drive mechanism is provided for moving the coin support between retracted and extended positions in relation to the housing. The drive mechanism includes an electric motor and a control circuit for the electric motor including a control switch for initiating operation of the electric motor for displacement of the coin support from the retracted to the extended position.

One advantage of the present invention is the provision of an improved coin bank of the character having a coin receiving component displaceable between retracted and extended positions relative to a coin bank housing.

Another advantage is the provision of a coin bank of the foregoing character in which the coin receiving component is displaceable between the retracted and extended positions by a semi-automatic displacement device, which can be a motor operated drive mechanism.

A further advantage is the provision of a coin bank of the foregoing character in which the coin receiving component is selectively releasable from the displacement device for manual displacement between the retracted and extended positions thereof.

BRIEF DESCRIPTION OF THE DRAWINGS

The invention may take form in various component and arrangements of components as will be pointed out more fully hereinafter in conjunction with the written description of a preferred embodiment of the invention illustrated in the accompanying drawings in which:

FIG. 4 is an enlarged exploded perspective view of the drawer drive unit of the coin bank;

DESCRIPTION OF A PREFERRED EMBODIMENT

Figure 2:
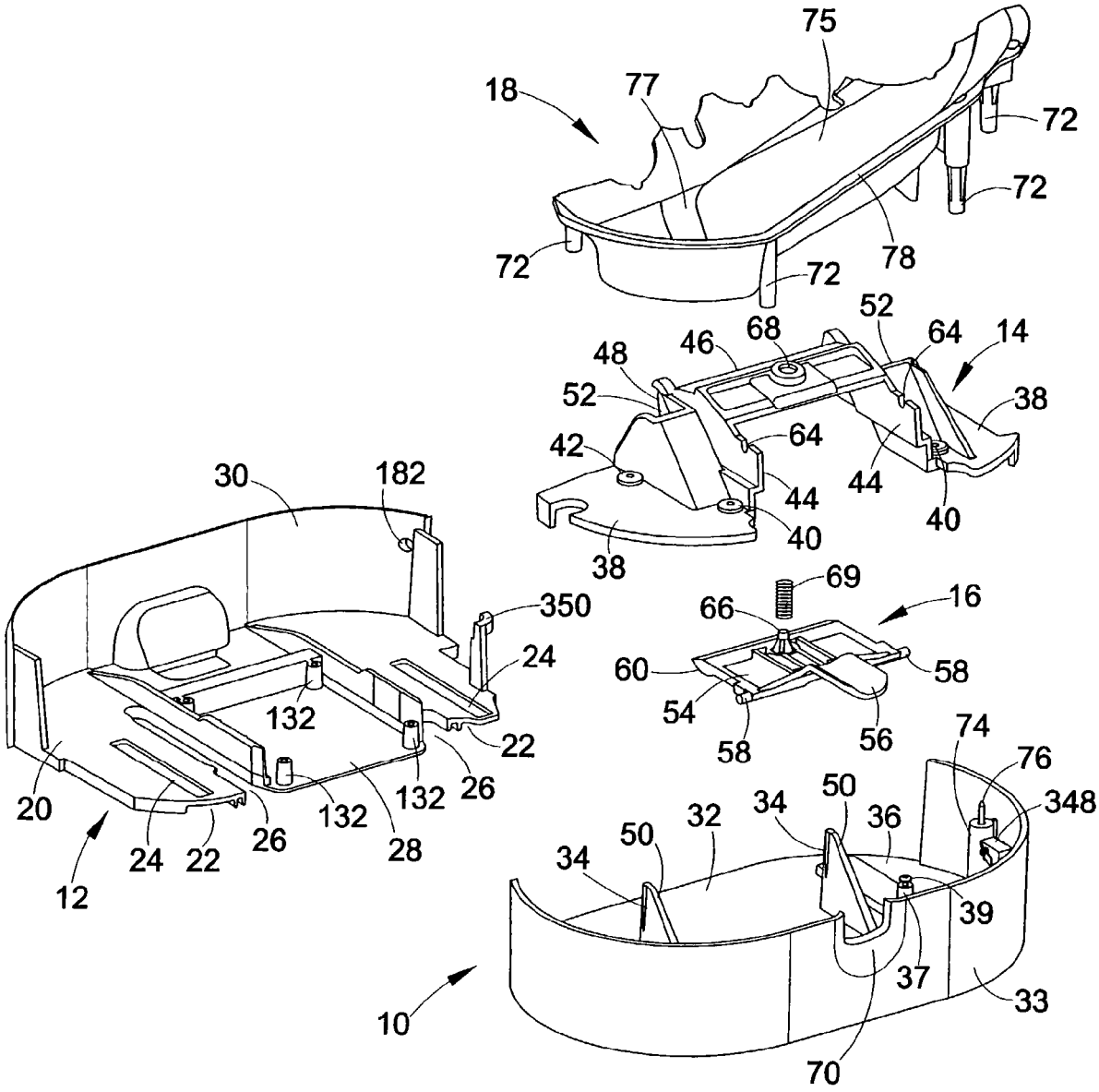
FIG. 2 is an enlarged exploded perspective view of the component parts of the base and drawer portion of the coin bank.
Figure 3A:
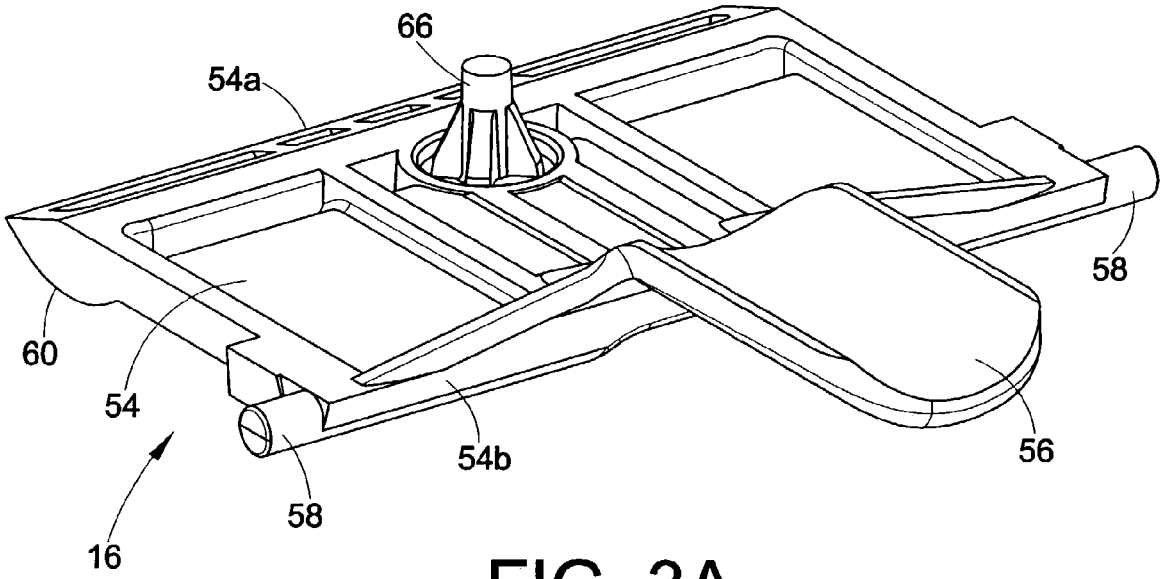
FIG. 3A is an enlarged perspective view of the release lever from the rear end thereof.
Figure 3B:
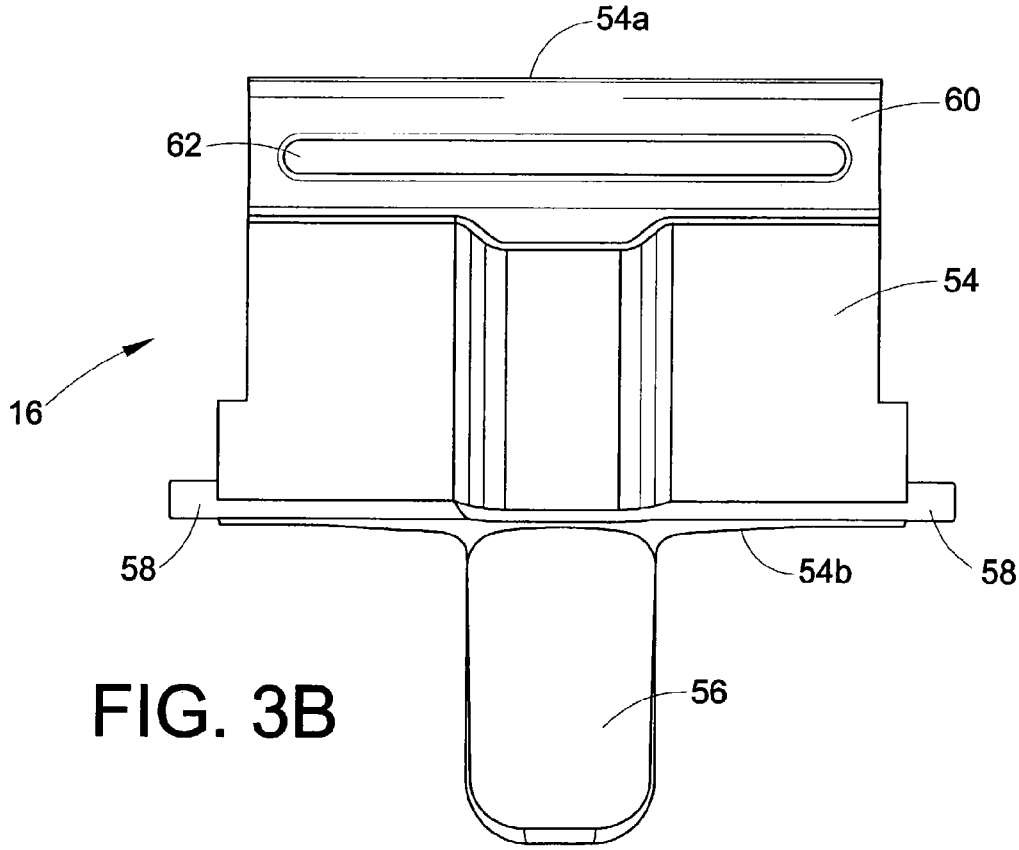
FIG. 3B is a plan view of the bottom side of the release lever of FIG. 3A.
Figure 5:
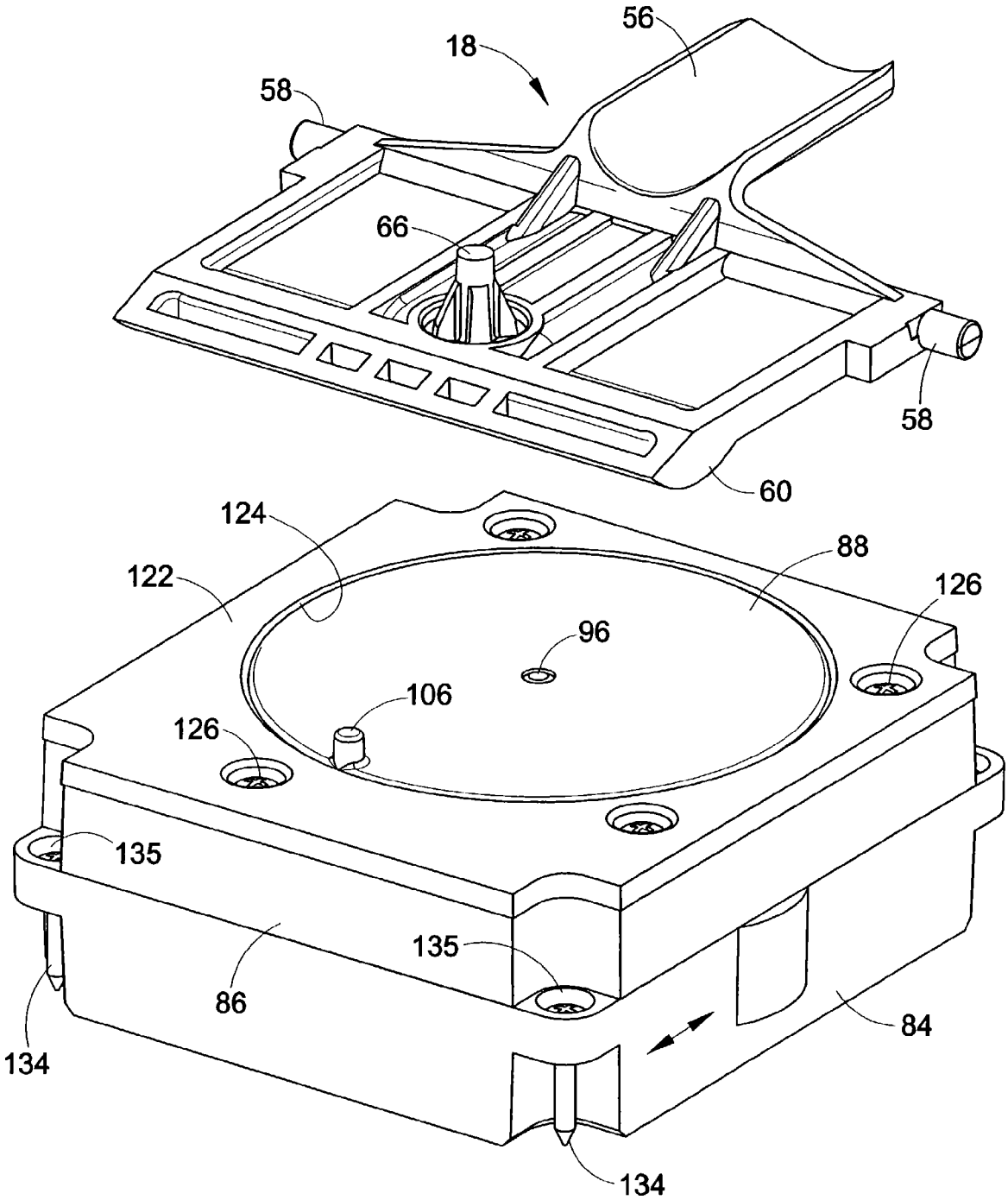
FIG. 5 is an enlarged perspective view of the drawer drive unit and release lever.

Referring now in greater detail to the drawings wherein the showings are for the purpose of illustrating a preferred embodiment of the invention only and not for limiting the invention, the component parts of and an assembled coin bank in accordance with the present invention are illustrated in the drawings. More particularly in this respect, and with reference first to FIGS. 1A, 2, 3, and 7–9, the coin bank includes a base and drawer portion comprising a base 10, a drawer 12 slidably supported on the base as set forth more fully hereinafter, a ramp 14, a coupling and release component 16 which is pivotally mounted on ramp 14 for the purpose set forth hereinafter and a coin overflow compartment 18. Drawer 12 includes a bottom wall 20 having a pair of laterally spaced apart upwardly open linear guide recesses 22 in the underside thereof and corresponding guide slots 24 opening thereinto through the bottom wall. The bottom wall further includes a pair of slots 26 on laterally opposite sides of a central drawer drive unit mounting area 28 of the bottom wall. The drawer further includes a front wall 30 extending upwardly from bottom wall 20 and having a finger recess 31 in the front side thereof. Base 10 has a bottom wall 32 and a rear wall 33 extending upwardly therefrom. Bottom wall 32 is provided with a pair of laterally spaced apart upwardly extending triangular ribs 34 and a pair of guide bars 36 laterally outwardly adjacent the ribs, only one of which guide bars is visible in FIG. 2. Ribs 34 are aligned with slots 26 in the bottom wall of drawer 12, and guide bars 36 extend longitudinally of bottom wall 32 of the base and are aligned with and received in guide recesses 22 in the underside of bottom wall 20 of the drawer when the base and drawer are assembled. A mounting post 37, only one of which is visible in FIG. 2, is integral with and extends upwardly from each guide bar 36 and through the corresponding one of the guide slots 24. The drawer is slidably mounted and retained on base 10 by ramp component 14. More particularly in this respect, ramp 14 includes a pair of laterally outwardly extending flanges 38 by which the ramp component is mounted on base 10 through the use of fasteners 39, only one of which is visible in FIG. 2, extending downwardly through mounting buttons 40 and 42, only one of the latter of which is visible in FIG. 2. Fasteners 39 extend into mounting posts on the base including posts 37. Guide recesses 22 and guide bars 36 cooperatively guide sliding displacement of drawer 12 relative to base 10 and between extended and retracted positions relative thereto, and mounting posts 37 are adapted to interengage with the longitudinally opposite ends of guide slots 24 to limit displacement of the drawer in the directions of extension and retraction relative to the base.

Ramp 14 further includes a bridging portion between flanges 38 defined by upwardly extending walls 44 and a cross piece 46 therebetween and spaced above the plane of flanges 38. An inclined ramp surface 48 is provided adjacent the outer side of each of the walls 44, only one of which ramp surfaces is visible in FIG. 2, and when ramp 14 is mounted on base 10 each of the ramp surfaces 48 overlies and is spaced above a correspondingly inclined ramp surface 50 on ribs 34 of the base. The ramp further includes a rearwardly extending pocket 52 laterally outwardly adjacent each of the ramp surfaces 48 and which, together with the corresponding ramp surfaces 48 and 50 serve the purpose which will become apparent hereinafter.

Coupling and release component 16 is in the form of a lever having a generally rectangular body portion 54 and an operating arm 56 extending rearwardly from the rear edge of the body portion. A pair of pivot pins 58 extend laterally outwardly from the opposite sides of the body portion at the rear edge thereof, and a laterally extending convex surface 60 extends along the underside of the front edge thereof between the opposite sides of the body portion and is provided with a linear cam pin recess 62. The lever is mounted on ramp 14 by engaging pins 58 in pin receiving recesses 64 in side walls 44 of the ramp with body portion 54 underlying cross member 46 of the ramp. As described in greater detail hereinafter, recess 62 in lever 16 is cooperable with a cam pin component of a motor drive unit on the drawer to provide for motor operated displacement of the drawer between the retracted and extended positions thereof relative to base 10, and the lever is pivotal to disengage recess 62 from the cam pin to enable manual displacement of the drawer between the retracted and extended positions thereof. The lever is spring biased to engage with the motor drive unit and, for this purpose, the upper side of body portion 54 is provided with a spring retaining projection 66 and cross member 46 of the ramp is provided with a downwardly open spring receiving recess 68 in the underside thereof. A biasing spring 69 is captured between post 66 and recess 68, and lever 16 is retained on ramp 14 by suitably closing the upper ends of pin slots 64, such as by a plastic strip adhesively bonded to the upper ends of walls 44. When ramp 14 is mounted on base 10, terminal end of operating arm 56 is accessible through an opening 70 provided in rear wall 33 of the base.

Coin overflow compartment 18 is mounted on base 10 to overlie ramp component 14 and, for this purpose, is provided with mounting posts 72 aligned with corresponding mounting posts 74 on base 10, only one of which posts 74 is visible in FIG. 2. Each pair of posts 72 and 74 receives a corresponding fastener 76 which extends upwardly through post 74 from the underside of bottom wall 32 of base 10 and into post 72. The coin overflow component includes a slide plate portion 75 inclined downwardly and laterally toward a pocket 77 which is accessible from outside the bank and which receives excess coins introduced into the bank. Rear edge 78 on the overflow component is interengaged with a housing component as set forth hereinafter to provide further support for the overflow component.

With reference now to FIGS. 1A, 4, 5, 8, and 9 of the drawing, the coin bank further includes a drawer displacement device. In one embodiment, the displacement device can comprise an electric motor 80 and a gear train 82 driven thereby. The motor and gear train are captured between and supported by lower and upper housing members 84 and 86, respectively. The drive unit further includes a circular cam plate 88 having a downwardly extending circumferential flange 90 received in a circular recess 92 in the upper side of upper housing member 86. Cam plate 88 is provided with a central aperture 94 which receives the upper end of a support shaft 96 mounted on lower housing member 84 by an apertured mounting post 98 which receives the lower end of the shaft. Cam plate 88 is, adapted to be rotated about shaft 96 by motor 80 through gear train 82. More particularly in this respect, the underside of cam plate 88 is provided with a gear 99, which is concentric with opening 94 and received in a recess 100 in upper housing member 86, and gear train 82 includes an output gear 102, a peripheral portion of which extends through a window 104 in recess 100 to mesh with gear 99. The cam plate is provided with a cam pin 106 radially spaced from and rotatable about shaft 96 in response to energizing motor 80, and the outer periphery of the cam plate is provided with diametrically opposed cam track portions 108 and diametrically opposed recesses 110 therebetween for alternately and sequentially opening and closing a microswitch 112 of the drive unit which is mounted in a pocket 114 provided therefor in upper housing member 86. As will become apparent hereinafter, switch 112 is part of a control circuit for motor 80 by which the operation thereof is controlled with respect to displacing the drawer between the retracted and extended positions thereof.

Upper and lower housing members 84 and 86 are interconnected by a plurality of threaded fasteners such as fastener 116 which extend through an opening 118 therefor in the upper housing member and into a corresponding mounting post 120 in the lower housing member. A cover plate 122 overlies upper housing member 86 and includes a circular opening 124 having a peripheral edge which overlies cam track 108 on cam plate 88 and thus axially captures the cam plate relative to the upper housing member. The cover plate is secured to the upper housing member by a plurality of threaded fasteners, such as fastener 126, which extend through openings 128 in the cover and into threaded bores 130 in the upper housing member. When assembled, and as will be appreciated from FIGS. 1A and 2, the drive unit is mountable on portion 28 of bottom wall 20 of drawer 12 by means of mounting posts 132 on the drawer and threaded fasteners 134 which extend through openings 135 therefor in lower housing member 84 and into the mounting posts.

Referring now to FIGS. 1A, 2, 6, 8, and 9 of the drawing, the coin bank further includes a coin storage tube unit mounted on drawer 12 and comprising a coin tube base 136, a coin tube support wall member 138, a plurality of coin tubes 140, and a window component 142 which can be of smoked plastic. Coin tube base 136 comprises a shelf 144 provided with a plurality of recessed areas 146–154, each of which receives a corresponding one of the coin tubes 140. A more detailed description of the structures of the recessed areas and the interrelationship thereof with the coin tubes is set forth in co-pending application Ser. No. 09/879,732 filed Jun. 12, 2001, the subject matter of which application is incorporated herein by reference in its entirety. A ledge 156 is positioned rearwardly of the recessed areas of base 136 and includes a scalloped front surface 158 which accommodates the different diameters of the coin tubes 140. Coin tube support wall member 138 is mounted on ledge 156 and includes a scalloped front surface 160 corresponding in contour to surface 158 of the coin tube base. Further in this respect, support member 138 has a bottom surface 161 which rests on ledge 156, and fasteners 162 extend upwardly through openings 164 in ledge 156 and into tube mounting posts 164 in wall member 138. The coin tube support member further includes a plate portion 165 which extends rearwardly from the upper end thereof and inclines downwardly relative thereto in the direction from right to left in FIG. 6A. Forwardly extending walls 166 are provided on the laterally opposite ends of member 138, and walls 166 include laterally outwardly extending mounting flanges 168, to which window 142 is mounted by fasteners 172 which extend through openings 174 in mounting flanges 168 and into corresponding mounting posts 176 extending rearwardly from the inner side of window 142.

Figures 6A, 6B:
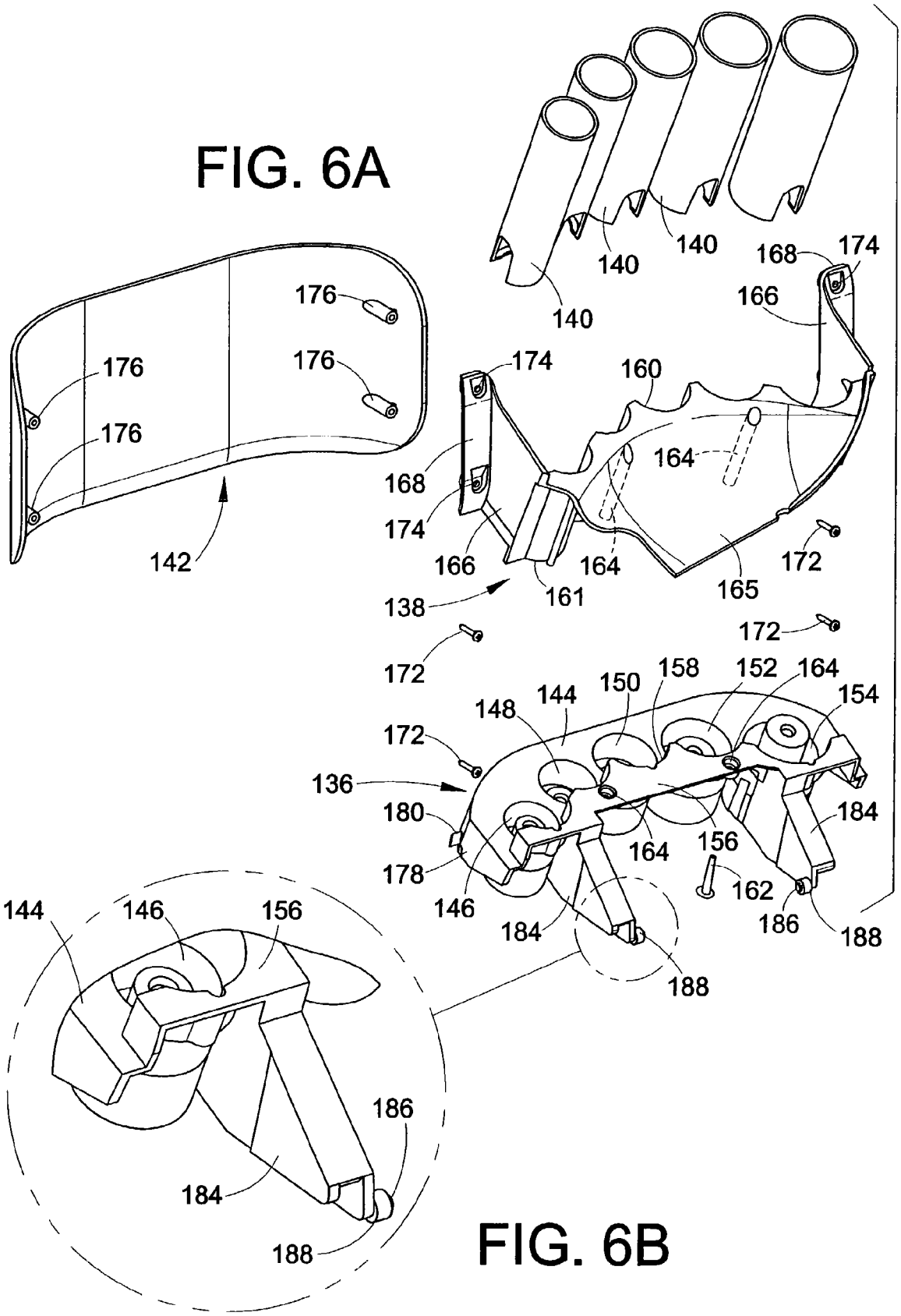
FIG. 6A is an enlarged exploded perspective view of the coin storage tube unit of the coin bank.
FIG. 6B is an enlarged detail view of a roller on the coin tube base.
Figure 7A:
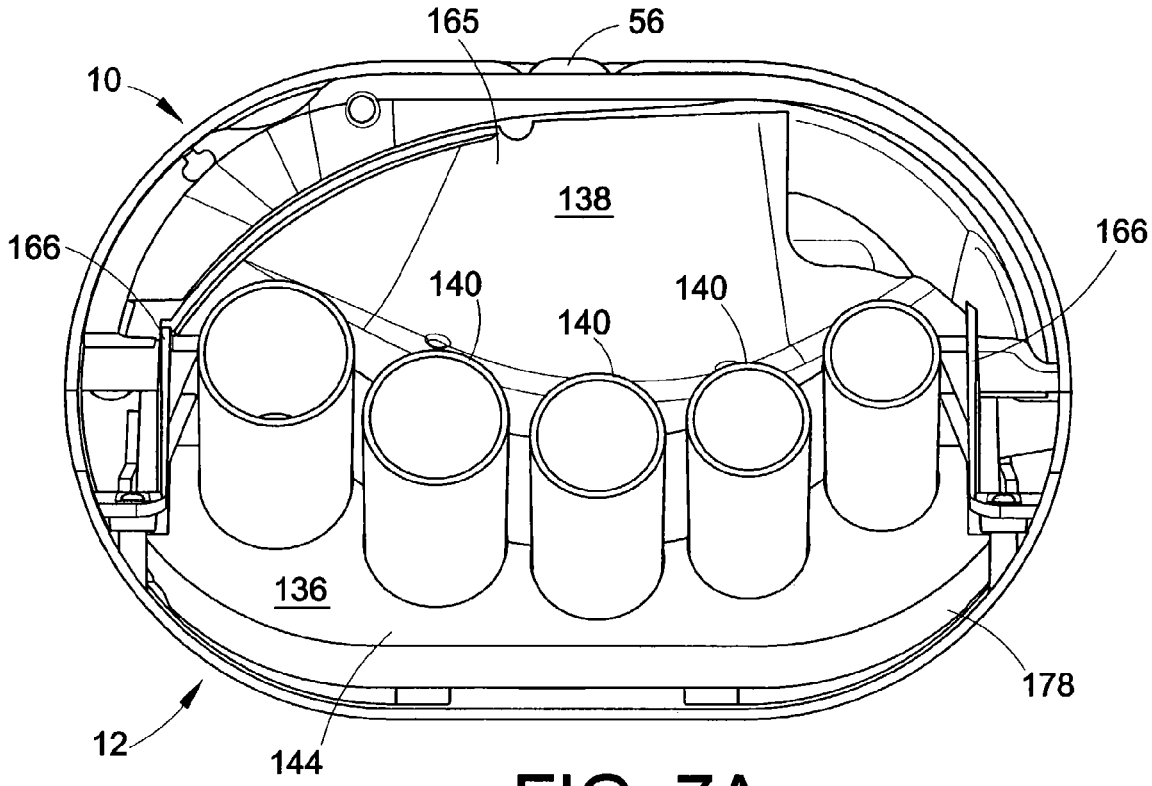
FIG. 7A is a plan view of the base and drawer unit in the retracted position of the drawer.
Figure 7B:
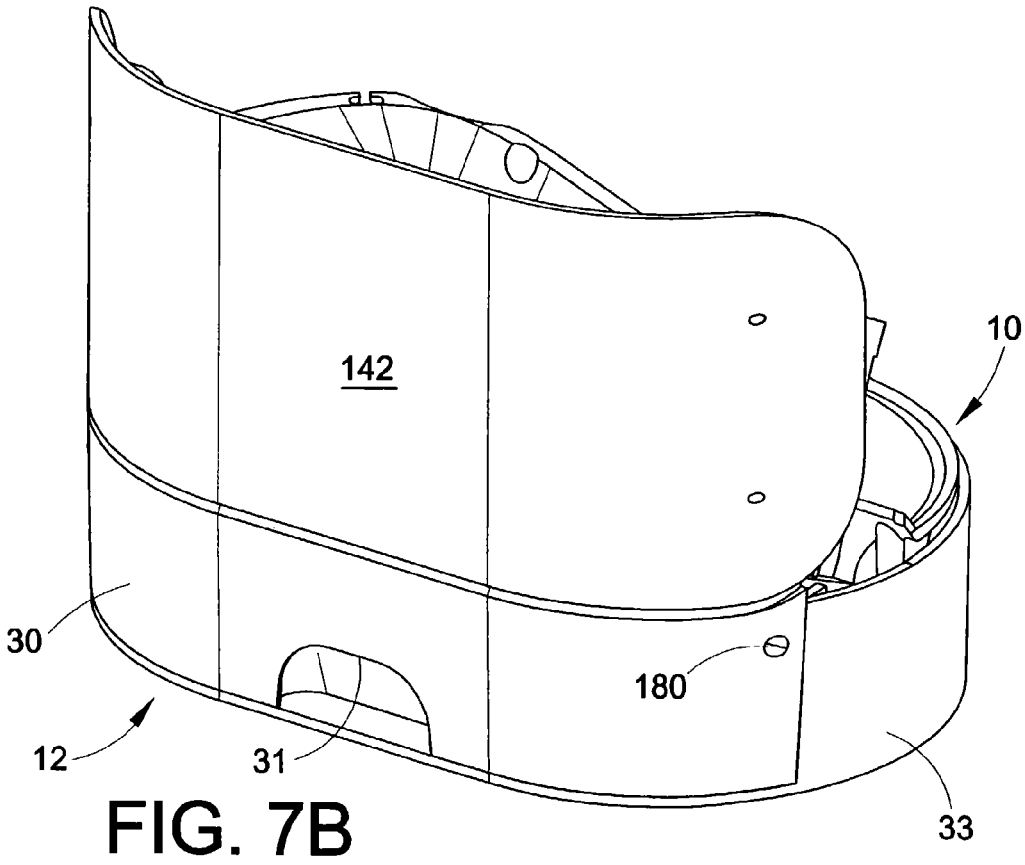
FIG. 7B is a perspective view of the base and drawer unit shown in FIG. 7A.

A wall or skirt 178 depends from shelf 144 of base 136 and extends across the front and laterally opposite sides of the coin base, and a pair of pivot pins 180, only one of which is visible in FIG. 6A, extend outwardly from the laterally opposite sides of the base member for pivotally mounting the latter on drawer 12. More particularly, in this respect, as will be appreciated from FIG. 2, the laterally opposite sides of front wall 30 of drawer 12 are provided with pin openings 182, only one of which is visible, which receive pins 180, whereby coin tube base 136 is pivotal relative to drawer 12. As will become apparent hereinafter, pivotal movement of the base relative to the drawer is in response to displacement of the drawer between the extended and retracted positions thereof relative to housing base 10. Such pivotal movement of the coin tube base is achieved through interengagement between the latter and ramp 14 on the base. In this respect, coin tube base 136 includes a pair of rearwardly extending arms 184, each of which is provided on the inner side at the rear end thereof with an axle 186 and a corresponding roller 188. When the drawer with the coin tube base mounted thereon is mounted on housing base 10, rollers 188 engage in the corresponding ramp track slot defined by lower ramp surfaces 50 on flanges 34 on the housing base and upper ramp surfaces 48 on ramp 14. When the drawer is in the retracted position thereof relative to housing base 10, arms 184 are in ramp pockets 52 and rollers 188 are at the lower rearward ends of the ramp slots. During displacement of the drawer from the retracted to the extended position, rollers 188 move upwardly along the ramp slots to pivot the coin tube base from an inclined to a generally upright position relative to the drawer.

Figure 1A:
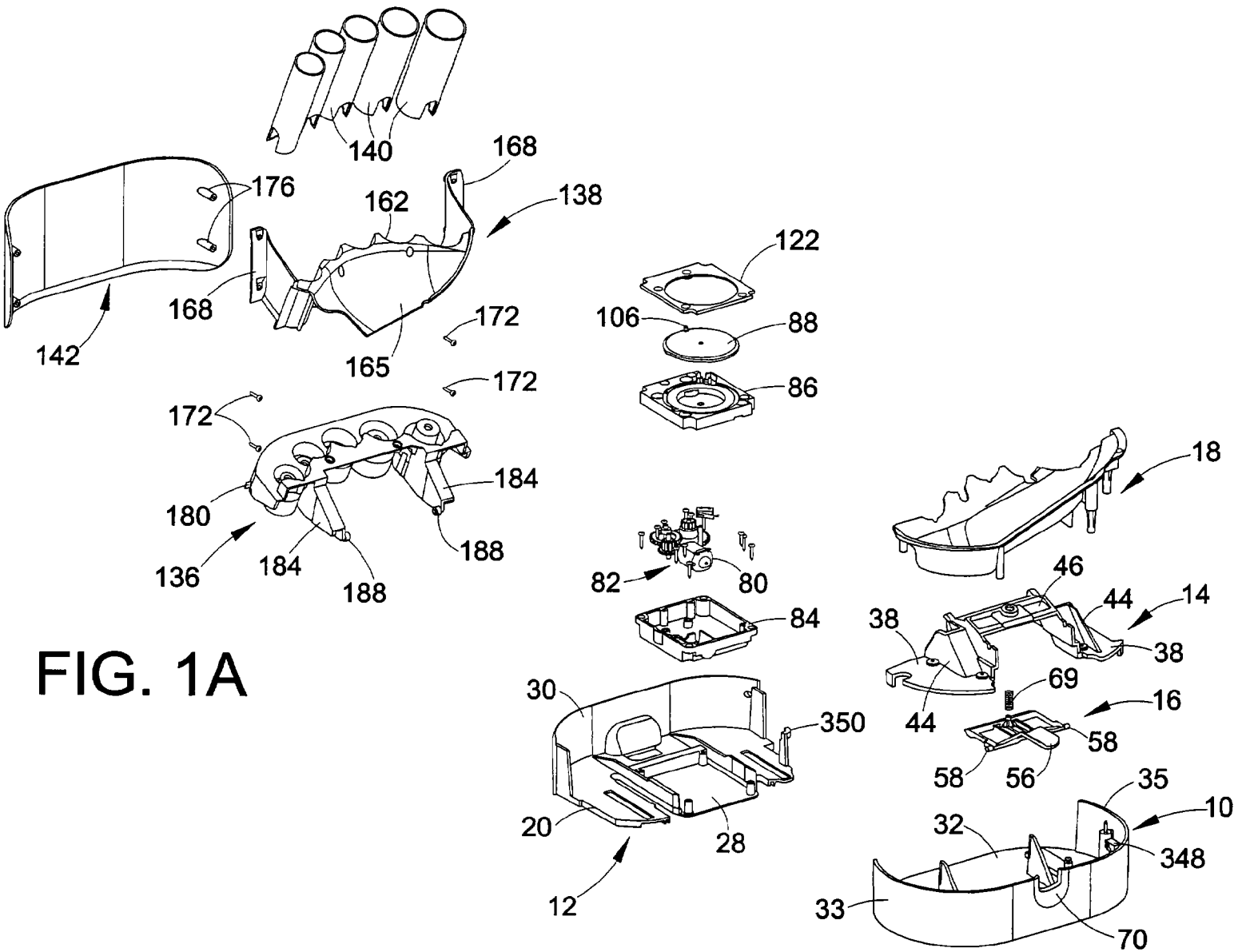
FIG. 1A is an exploded perspective view of the component parts of the base and drawer portion, drawer drive unit, and coin storage tube portion of a coin bank in accordance with the present invention.
Figure 1B:
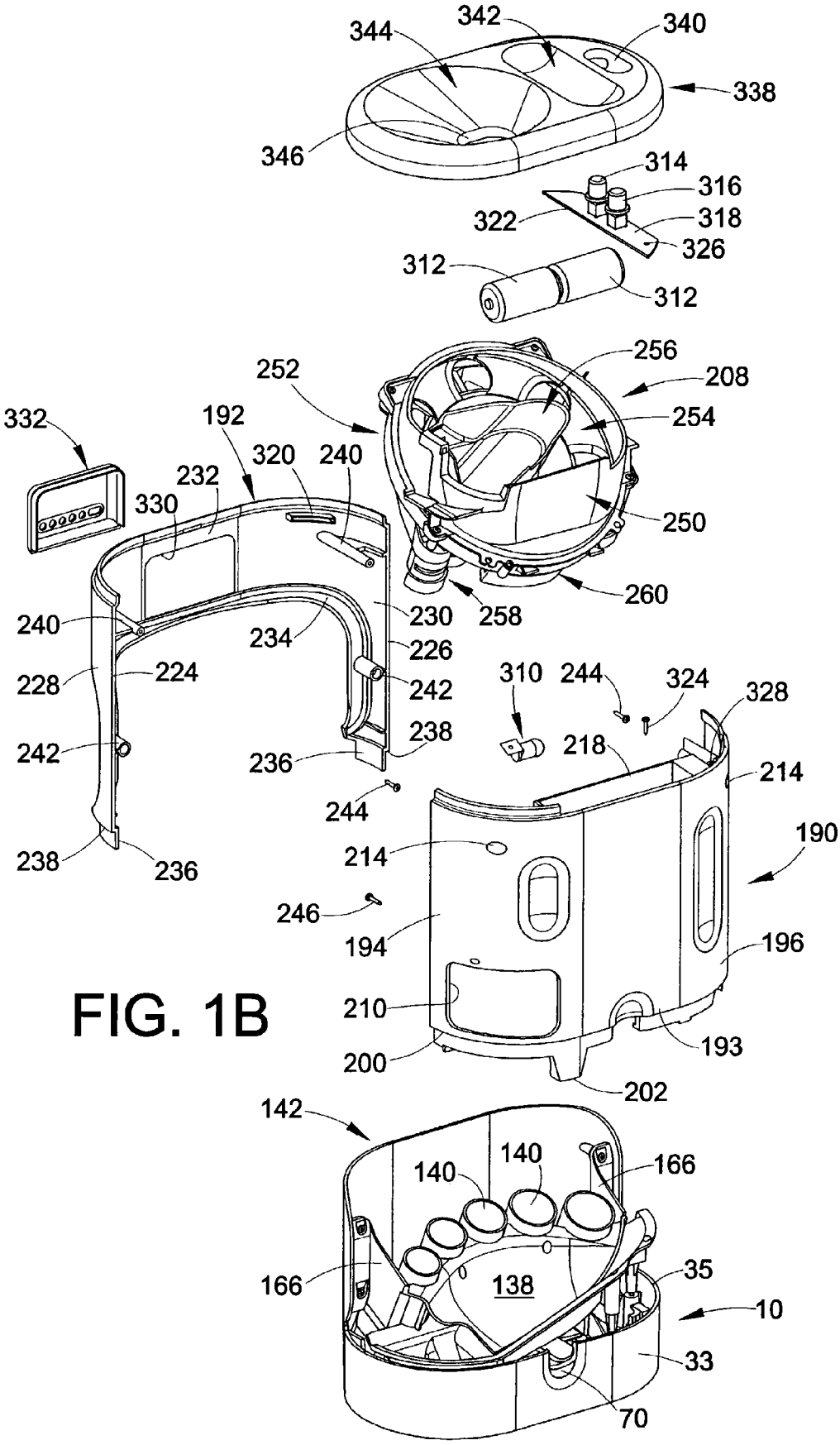
FIG. 1B is an exploded perspective view showing the assembly of the component parts in FIG. 1 together with the component parts of the front and rear housings and the coin sorting unit of the coin bank.
Figure 12:
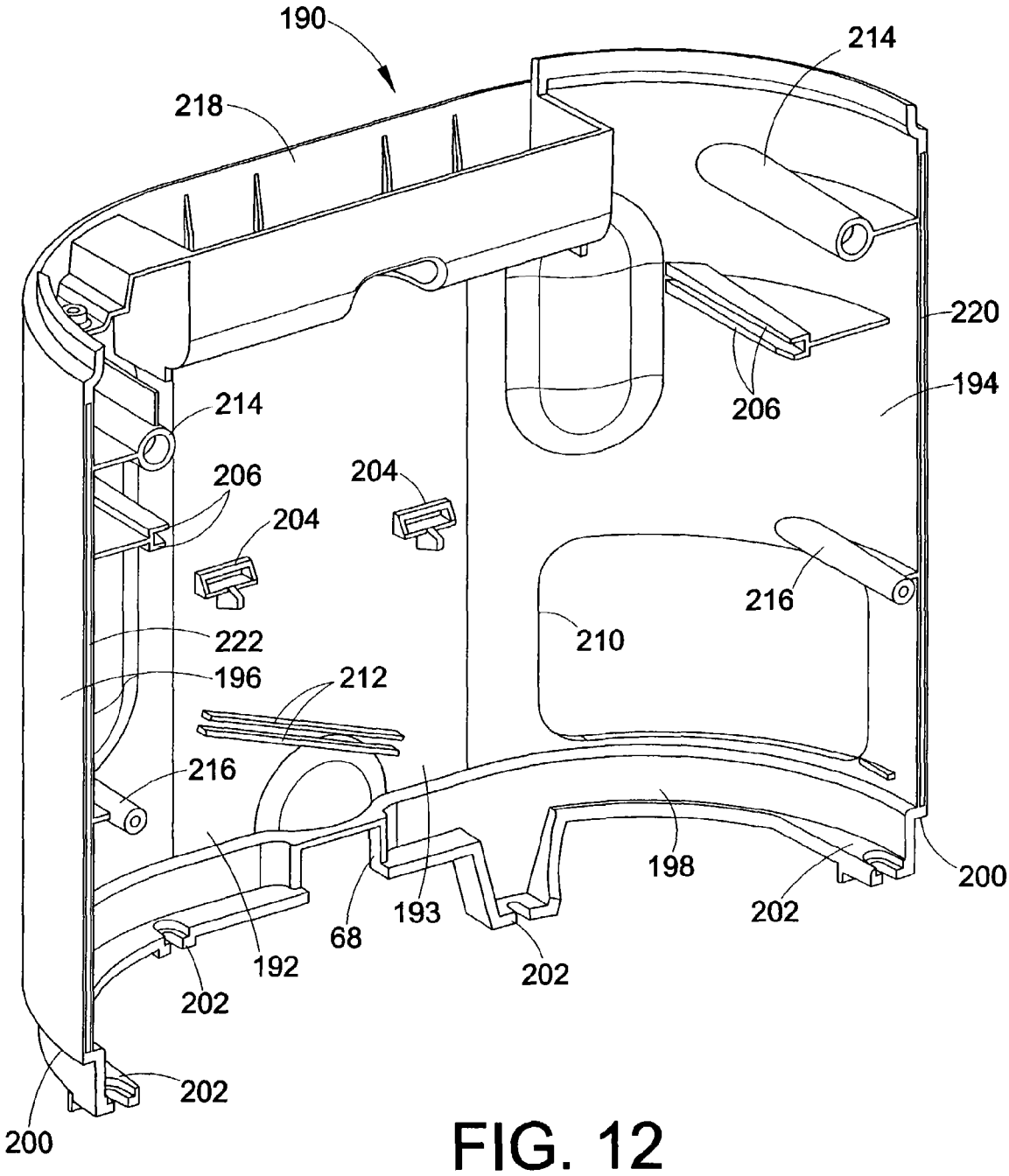
FIG. 12 is a perspective view of the inside of the rear housing component.
Figure 13:
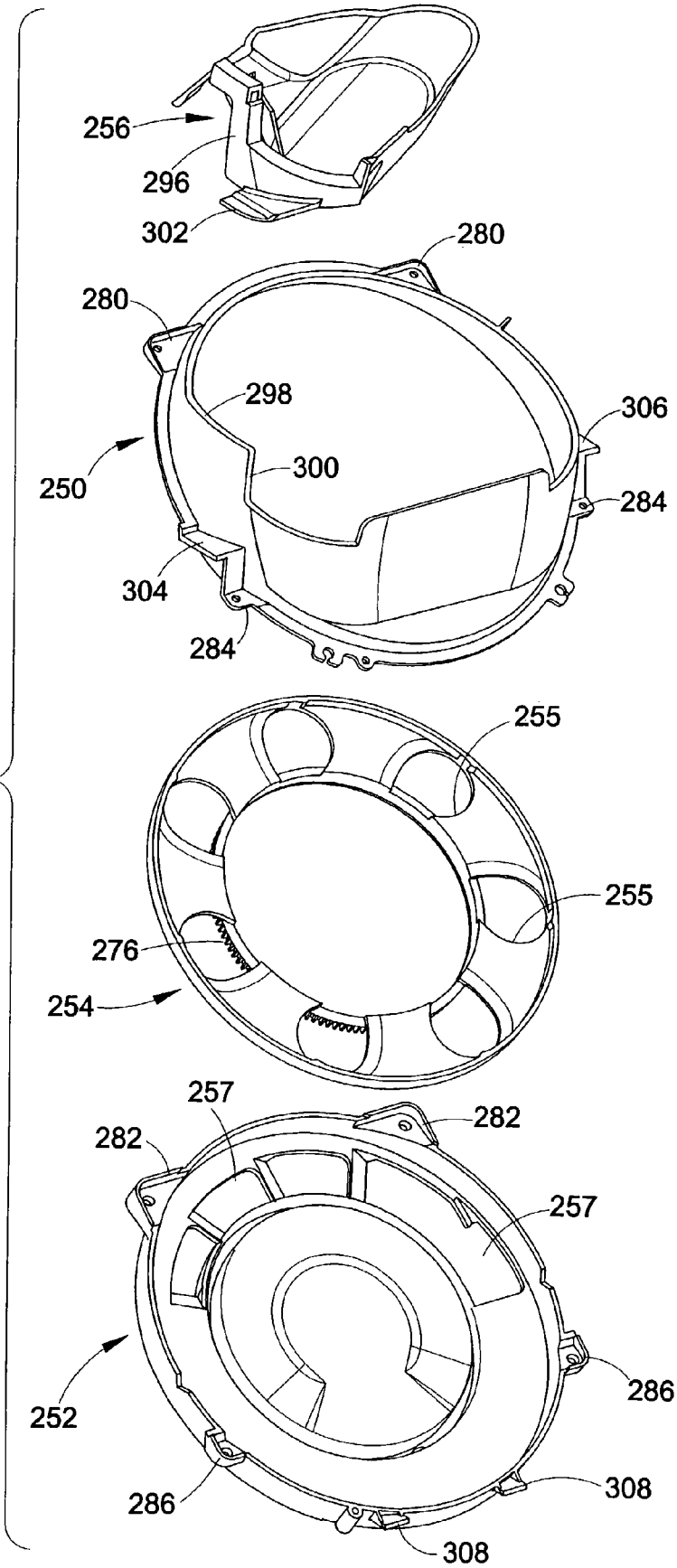
FIG. 13 is an exploded perspective view of the lower wheel housing, coin separating wheel, upper wheel housing, and hopper components of the coin separating and sorting unit.
Figure 14:
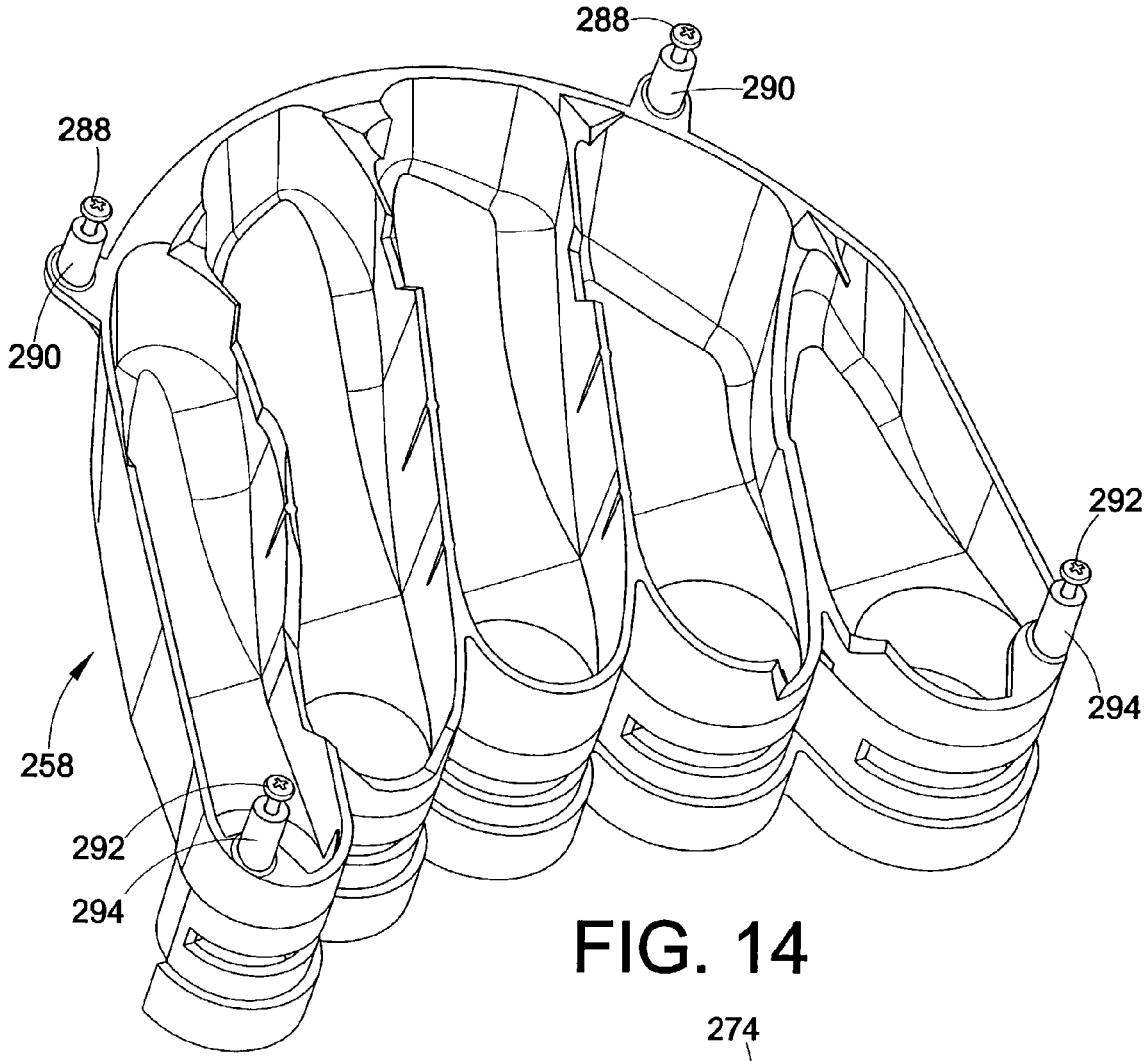
FIG. 14 is an enlarged perspective view of the coin slide component of the coin separating and sorting unit.
Figure 20:
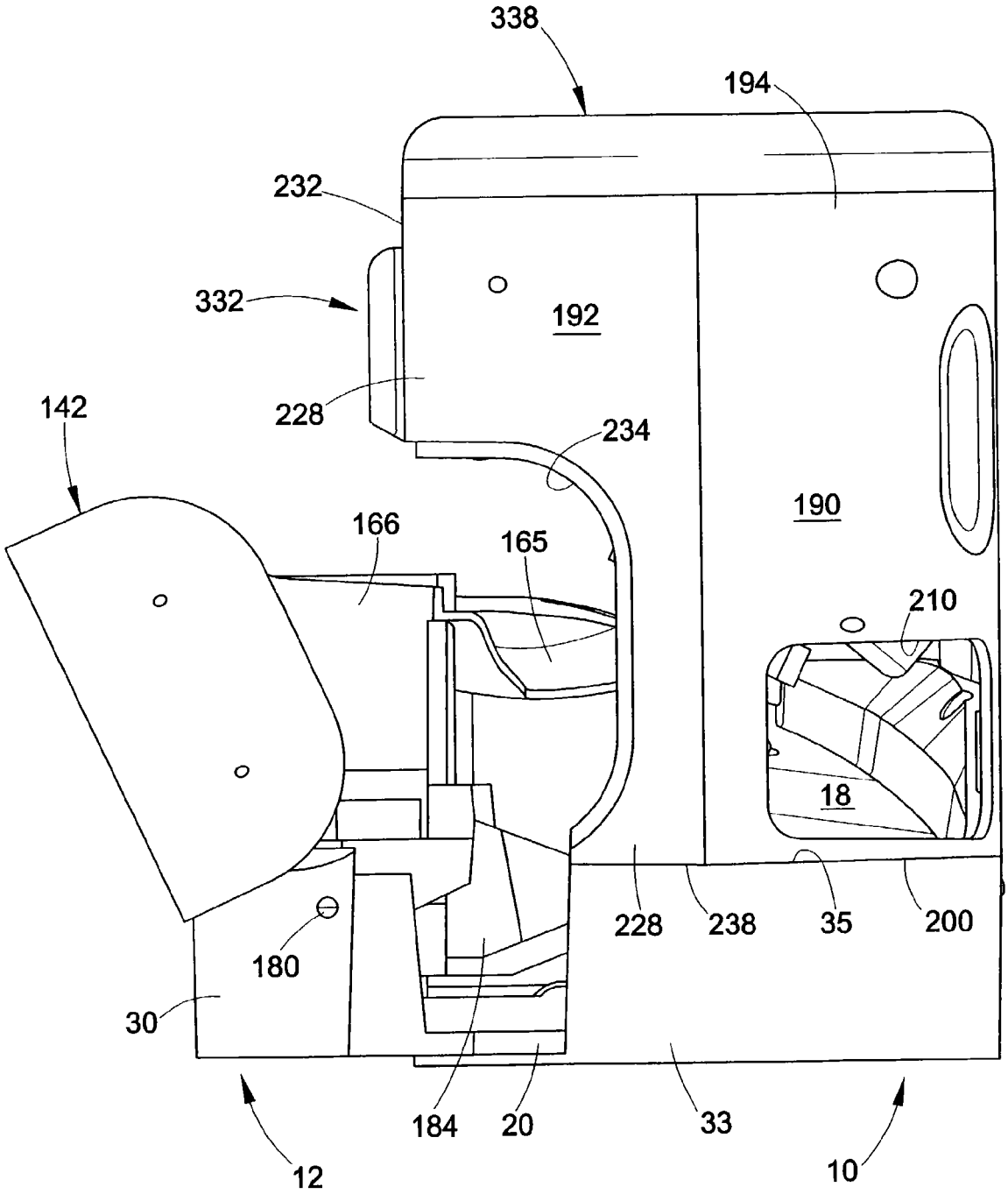
FIG. 20 is a side elevation view of the assembled coin bank and showing the drawer and coin storage tube unit in the extended position.

As shown in FIGS. 1B, 12 and 20, the coin bank further includes a rear housing 190 and a front housing 192 mounted on base 10 of the coin bank. More particularly in this respect, rear housing 190 includes a planar central rear wall portion 192 and arcuate side portions 194 and 196 the lower edges of which include a correspondingly contoured mounting flange 198 which is recessed inwardly of the wall portions to provide a shoulder 200 between the wall portions and mounting flange. The mounting flange is received inwardly adjacent rear wall 33 of base 10 with shoulder 200 resting on the upper edge 35 of wall 33, and rear housing 190 is attached to base 10 by means of inwardly extending mounting feet 202 which are captured between mounting posts 72 and 74 respectively on overflow member 18 and base 10 as shown and described in connection with FIGS. 1A and 2 of the drawing. The inner side of wall portion 193 of rear housing 190 is provided with a pair of sockets 204, and each of the side wall portions 194 and 196 is provided with a pair of ribs 206. Sockets 204 and ribs 206 facilitate the mounting of coin separating and sorting unit 208 in the housing of the coin bank as set forth more fully hereinafter. Side wall 194 of rear housing 190 further includes an opening 210 which provides access to overflow component 18, and a pair of ribs 212 are provided on wall portion 193 for supporting rear edge 78 of the overflow component. Each of the side wall portions 194 and 196 is provided with a mounting tube 214 and a mounting post 216 by which front housing 192 is fastened to rear housing 190 as set forth more fully hereinafter.

The upper end of rear housing 190 is provided with a battery compartment 218, and the front edges of side wall portions 194 and 196 are provided with mounting slots 220 and 222, respectively, for receiving mounting ribs 224 and 226 on side wall portions 228 and 230, respectively, of front housing 192. Front housing 192 further includes a generally planar front wall portion 232 between side portions 228 and 230, and an opening 234 is provided in the front and side wall portions to accommodate window 142 on the drawer assembly when the latter is in its retraced position. The lower edges of side wall portions 228 and 230 are provided with mounting flanges 236 which are spaced inwardly from the corresponding side wall portion to provide a shoulder 238, and each of the side wall portions 228 and 230 is provided with a mounting post 240 and a mounting tube 242. Front housing 192 is mounted on base 10 by introducing flanges 236 inwardly adjacent the inner side of wall 33 of the base or shoulders 238 to rest on the upper edge 35 of wall 33, by introducing ribs 224 and 226 into slots 222 and 220, respectively, by introducing mounting posts 240 into mounting tubes 214 of the rear housing and mounting posts 216 on the latter into mounting tubes 242 on front housing 192, and then introducing fasteners 244 into mounting tubes 214 from the rear side of rear housing 190 and into mounting posts 240 and introducing threaded fasteners 246, only one of which is shown in FIG. 1B, into mounting tubes 242 from the front side of front housing 192 and into mounting posts 216 on rear housing 190.

Figure 15:
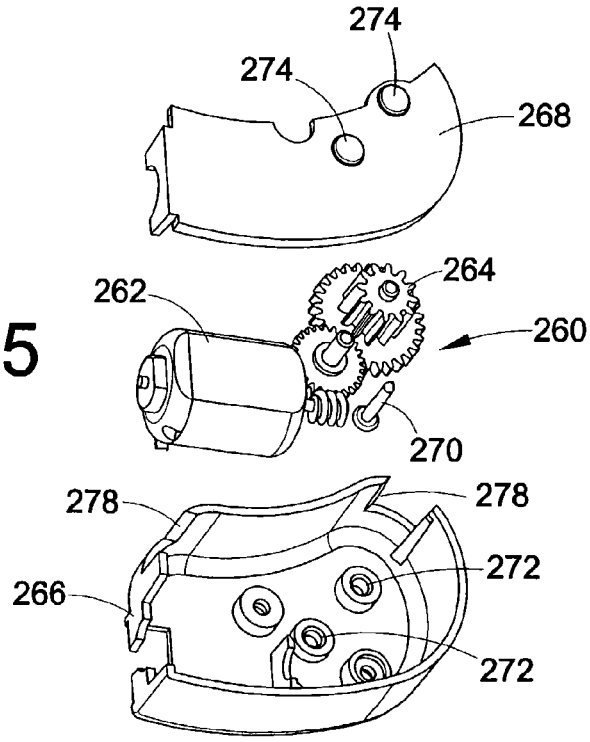
FIG. 15 is an exploded perspective view of the drive motor component of the coin separating and sorting unit.

Referring now to FIGS. 1B and 13–15, coin separating and sorting unit 208 comprises an upper wheel support 250, a lower wheel support 252, a coin separating wheel 254 captured therebetween and rotatable relative thereto, a hopper or coin receiver 256 mounted on upper wheel support 250, a coin slide 258 mounted beneath lower wheel housing 252, and a wheel drive motor and gear assembly 260 mounted on the under side of the lower wheel housing. The drive assembly comprises an electric motor 262 driving an output gear 264 through a gear train therebetween, and the motor and gears are mounted in a housing comprising a lower housing member 266 and a housing cover plate 268. The assembled drive unit is mounted on the under side of lower wheel housing by a pair of threaded fasteners 270, only one of which is shown in FIG. 15, extending through openings 272 and 274 in the housing members and into the under side of the lower wheel housing. Separating wheel 254 includes a depending circular flange having gear teeth 276 thereon and when the drive motor is assembled and mounted on the under side of lower wheel support 252, toothed flange 276 depends into the motor housing through slots 278 therein and into meshing engagement with drive gear 264. Upper wheel housing 250 and lower wheel housing 252 are provided with aligned mounting ears 280 and 282, respectively, and with aligned mounting flanges 284 and 286, respectively, and the wheel housing components are interconnected with one another and with coin slide 258 by means of threaded fasteners 288 which extend through mounting ears 280 and 282 and into mounting posts 290 on the coin slide and by threaded fasteners 292 which extend through mounting flanges 284 and 286 and into mounting posts 294 on the coin slide. Hopper 256 includes an inverted L-shaped mounting leg 296 having an inverted L-shaped mounting recess therein, not visible, and the recess receives the horizontal and vertical edges 298 and 300 of a wall portion of the upper wheel housing on which the hopper is mounted. The hopper also includes an outwardly extending mounting flange 302 which is generally co-planar with a mounting flange 304 on wheel housing member 250 when the hopper is mounted thereon, and flanges 302 and 304 are received between positioning ribs 206 on side wall portion 194 of rear housing 190 when the coin separating and sorting unit is mounted thereon. The diametrically opposite side of upper wheel housing 250 is provided with a mounting flange 306 which is received between positioning ribs 206 on side wall portion 196 of the rear housing. Further, lower wheel housing 252 is provided with a pair of mounting tabs 308 which are received in sockets 204 in rear wall portion 192 of rear housing 190.

Separating wheel 254 includes a plurality of coin openings 255 therethrough, and the underlying wheel support 252 includes a plurality of different sized coin sorting slots 257 therethrough. In the orientation shown in FIG. 13, separating wheel 254 rotates clockwise during a coin sorting operation and slots 257 increase in size in the clockwise direction. A more detailed description of the structure and operation of coin separating and sorting unit 208 is set forth in the aforementioned co-pending patent application and in co-pending application Ser. No. 09/780,826 filed Feb. 9, 2001 and the subject matter of which is incorporated herein by reference in its entirety.

Referring again to FIG. 1B, the coin bank further includes a light 310 suitably mounted on the under side of coin slide 258 adjacent opening 234 in front wall panel 232 of front housing 192 and which, as set forth hereinafter, is lit when sorting unit 208 is operating. The light is selectively operable to light the coin storage area when the drawer is in the extended position thereof. Batteries 312 for operating the drive motors 80 and 262 and light 310 are adapted to be received and supported in battery compartment 218, and the batteries are connected to the drive motors and light through a control circuit as set forth more fully hereinafter. The latter includes push button switches 314 and 316 mounted on a support plate 318 which in turn is mounted between rear and front housings 190 and 192 adjacent side wall portions 196 and 230 thereof by means of a pocket 320 receiving one end 322 of the support plate and a threaded fastener 324 extending through an opening 326 in the other end of the support plate and into a mounting post 328 on rear housing 190. Wall portion 232 offront housing 192 is provided with an opening 330 for receiving a display panel component 332 which can, for example, include a display screen 334 for selectively displaying information in response to activating one or more of a plurality of push buttons 336. The display component would be programed, such as through the use of a microprocessor, to provide such information as, for example, the total number of coins in the bank, the total number of coins in each value category, the total dollar value in the bank and/or in the individual coin tubes, and the like.

When the rear and front housings are mounted on the base and drawer assembly, the upper ends thereof are adapted to removably receive and support a top or cover component 338 which includes a recessed area 340 having openings therethrough for push button switches 314 and 316, a trough 342 such as for the temporary support of coins to be introduced into the bank, and a funnel area 344 having an opening 346 which overlies hopper 256 of coin separating and sorting unit 208.

Figure 16:
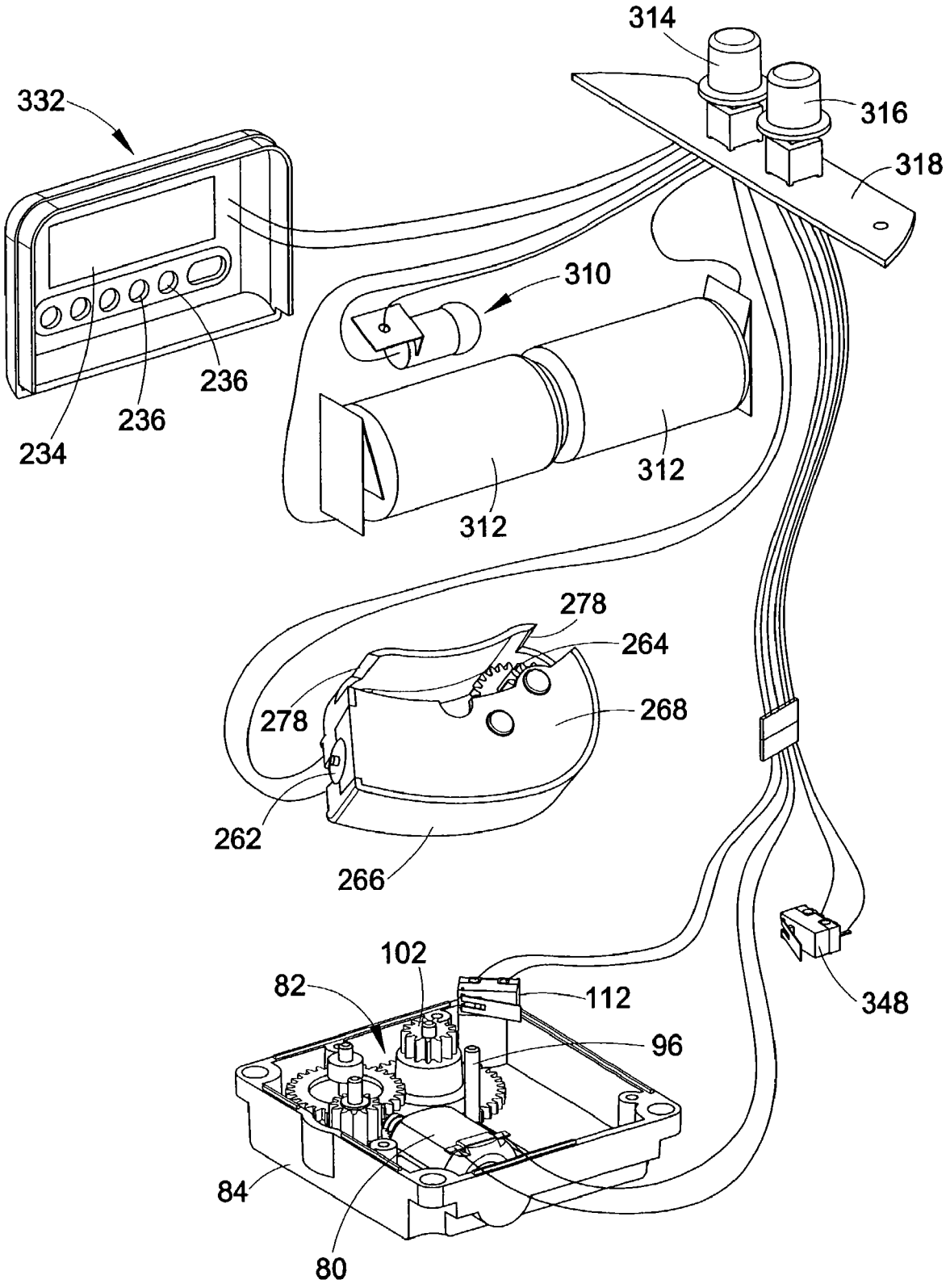
FIG. 16 is a perspective view of the wiring harness for the coin bank.
Figure 17:
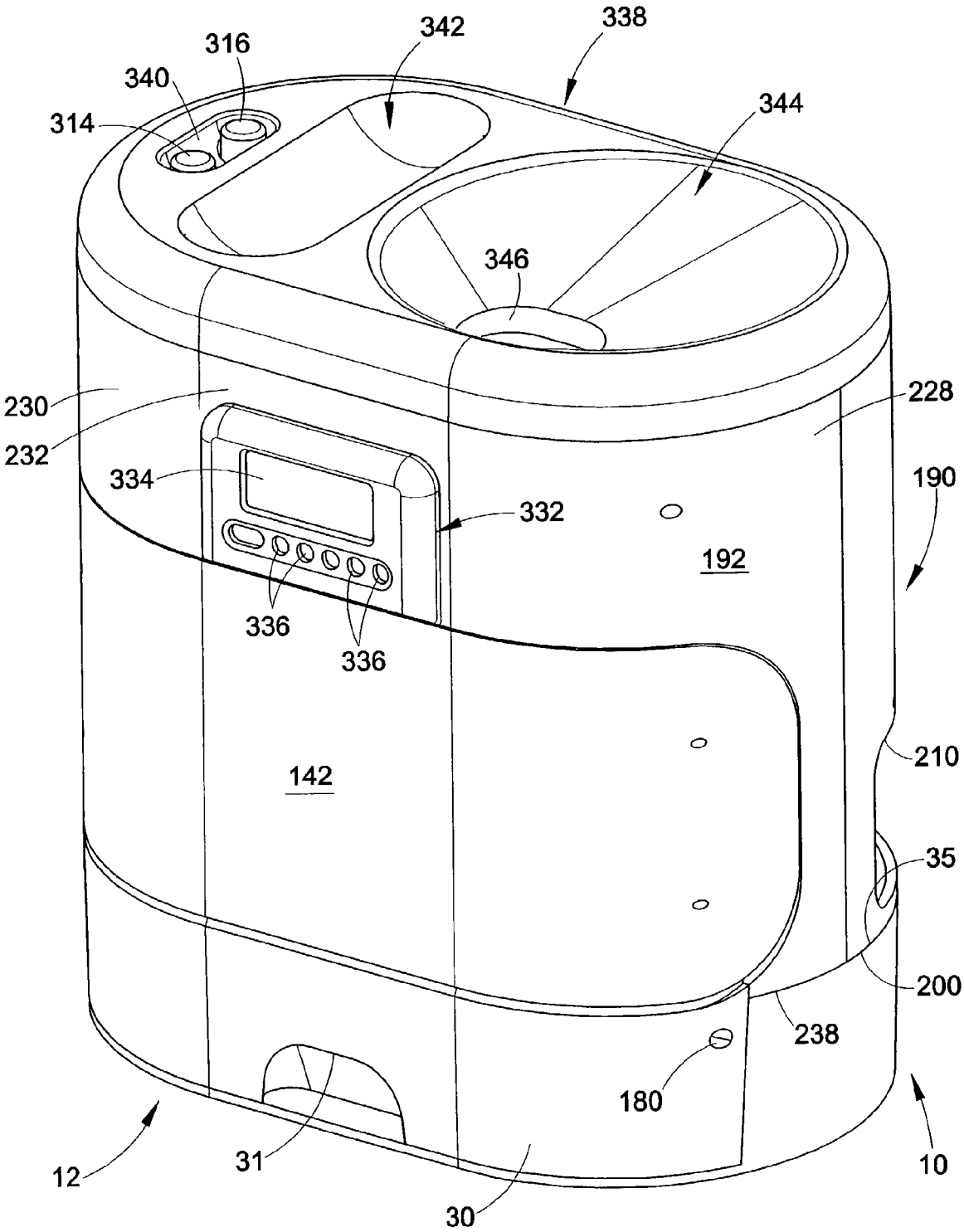
FIG. 17 is a perspective front view of the assembled coin bank and showing the drawer and coin storage tube unit in the retracted position thereof.

FIG. 16 illustrates a wiring harness for the coin bank which includes a control circuit for motor 262 of the coin separating and sorting unit comprising batteries 312, push button switch 314 and a microswitch 348 which, as shown in FIG. 2, is mounted on base 10. Switch 348 is adapted to be displaced between open and closed conditions by a switch actuating finger 350 mounted on bottom wall 20 of drawer 12. When the drawer is in the closed position thereof, finger 350 is operable to close the circuit through switch 348. As the drawer moves from the retracted toward the extended position thereof, finger 350 disengages from switch 348 to open the circuit therethrough. Light 310 is also adapted to be energized by batteries 312 through push button switch 314, independent of switch 348. Switch 314 is a latching/unlatching push button switch which is sequentially pushed to close and pushed to open the circuit thereacross, and the operation of the control circuit for motor 262 and light 310 is set forth hereinafter in connection with the operation of the coin bank. The wiring harness also provides a control circuit for motor 80 of the drawer drive unit which includes batteries 312, push button switch 316 and microswitch 112 in the housing for motor 80. As set forth hereinabove, microswitch 112 is adapted to be actuated between open and closed conditions by switch actuating cams 108 and recesses 110 on cam plate 88 of the drawer drive unit. Push button switch 316 is a momentary switch which is pushed to close the circuit thereacross and which, when released, operates to open the circuit.

With reference now in particular to FIGS. 16–20 of the drawing, the operation of the coin bank according to the present invention is as follows. Assuming the component parts to be in the positions shown in FIGS. 17 and 19 in which drawer 12 is in the retracted position thereof, microswitch 348 is closed, push button switches 314 and 316 are open, and one of the recessed areas 110 about the periphery of cam plate 88 is positioned relative to microswitch 112 for the latter to be open. Coins to be separated and sorted are dropped into funnel 344 and fall through opening 346 onto hopper 256 and then onto separating wheel 254. Separating wheel drive motor 262 and light 310 are energized by depressing push button switch 314, either prior to, during or following the feeding of coins onto the separating wheel. As drive motor 262 rotates separating wheel 254 through output gear 264, the coin separating and sorting unit 208 operates as described in detail in the aforementioned co-pending patent applications to separate the coins according to size, and thus denomination, and to deliver the separated coins to the appropriate one of the coin tubes 140. When the coin sorting process is completed, push button switch 314 is again depressed, whereupon the circuit through batteries 312 to motor 262 and light 310 is open to de-energize the motor and light.

Figure 18:
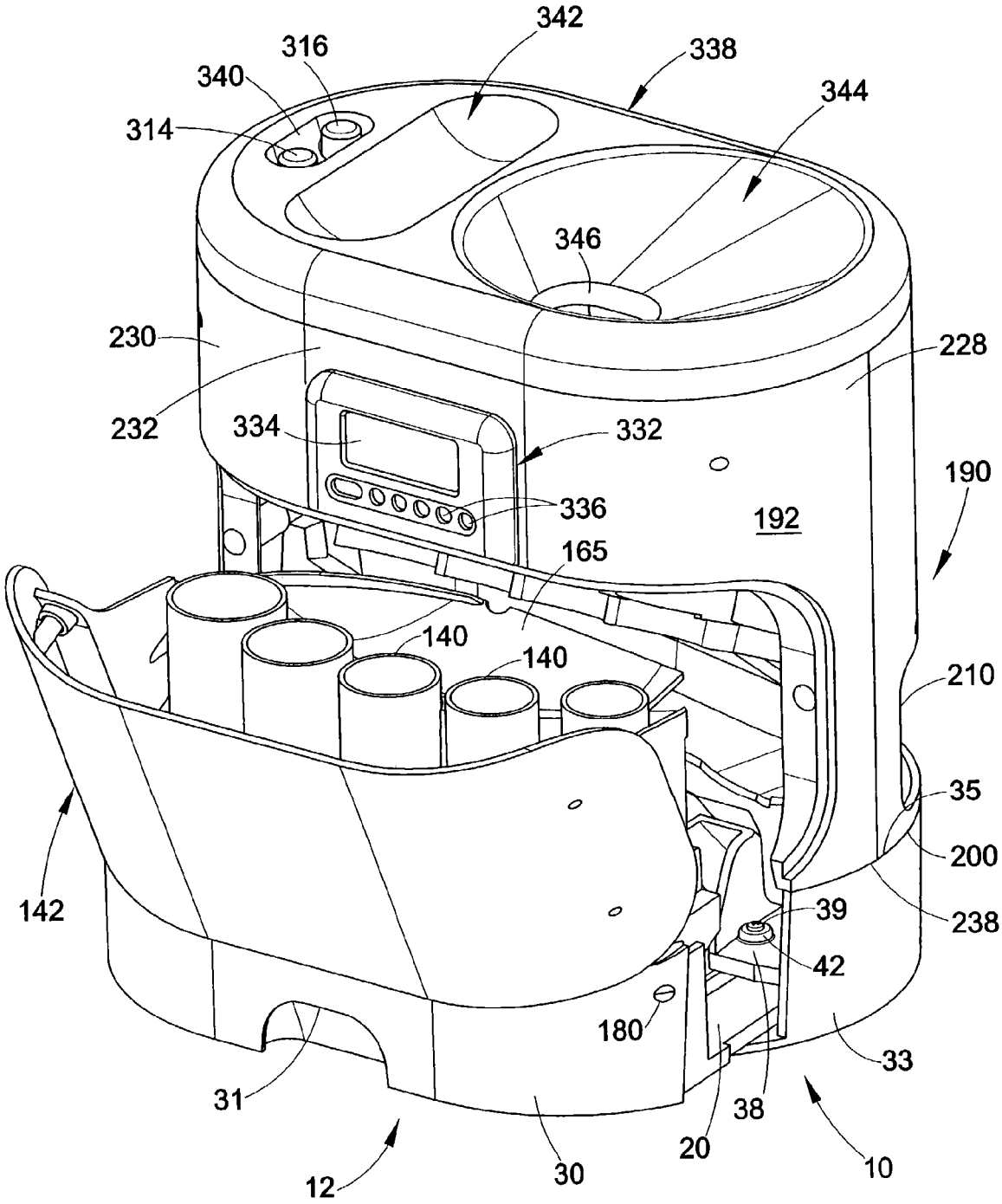
FIG. 18 is a perspective view similar to FIG. 17 and showing the drawer and coin storage tube unit in the extended position thereof.
Figure 19:
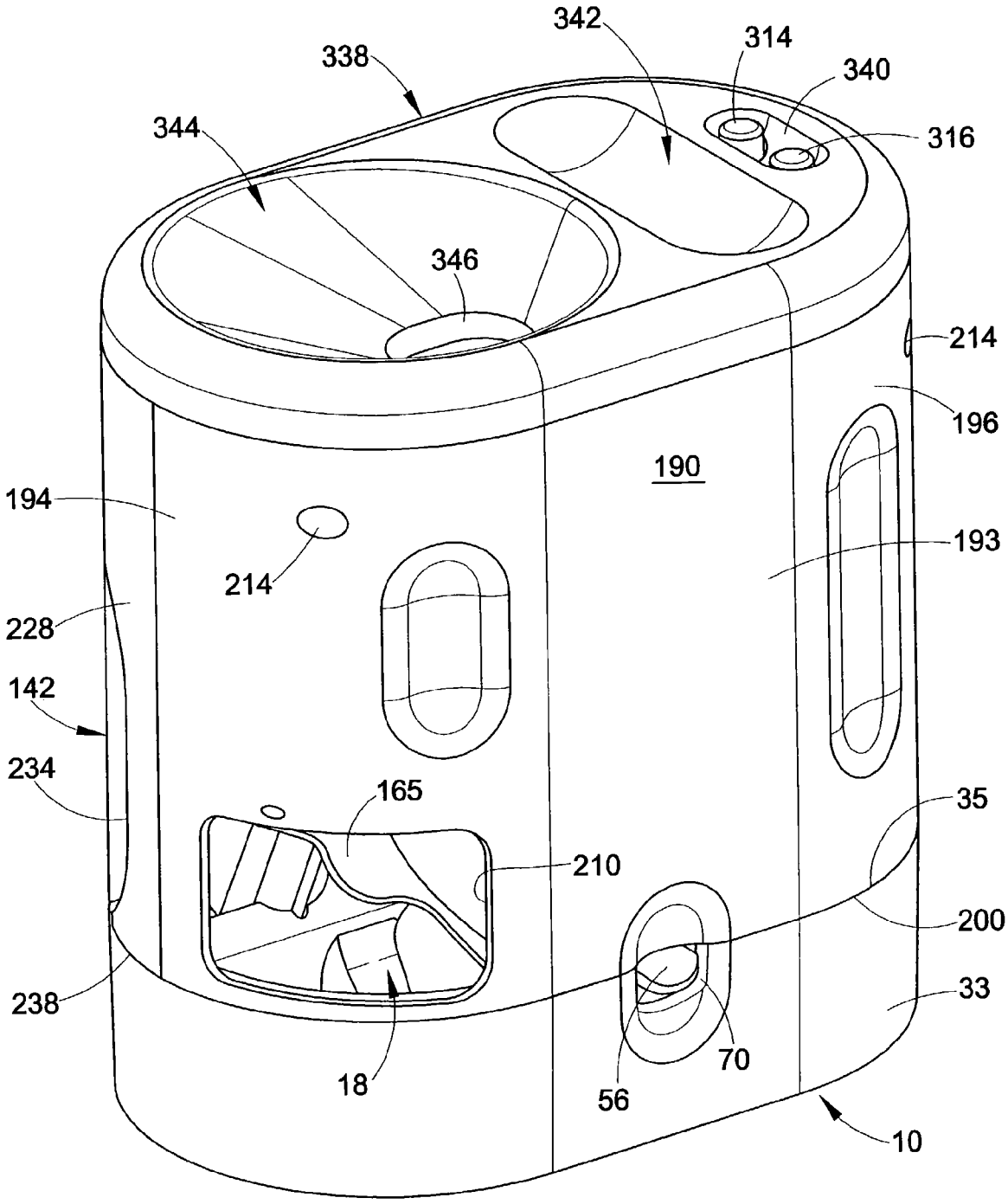
FIG. 19 is a perspective view of the rear side of the coin bank.

When it is desired to access the separated coins for removal from the bank, push button switch 316 is depressed, thereby closing the circuit to motor 80 through batteries 312, whereby the motor is energized to rotate cam plate 88 through output gear 102 of the drive unit. Initial rotation of cam plate 88 moves one of the switch actuating cam sections 108 relative to microswitch 112 to close the latter, whereupon push button switch 316 can be released and motor 80 continues to be energized by batteries 312 through microswitch 112. In response to rotation of cam plate 88, pin 106 engages in cam slot 62 in the bottom of lever 16 to displace the motor housing and thus drawer 12 from the retracted toward the extended position thereof. Initial movement of the drawer from the retracted toward the extended position moves switch actuating finger 350 on the drawer away from microswitch 348, whereby the latter opens to open the circuit for motor 262 independent of the position of push button switch 314. Accordingly, when microswitch 348 is open, the separating wheel cannot be actuated. However, light 310 can be connected to batteries 312 through switch 314 when microswitch 348 is open. When drawer 12 reaches the extended position thereof, as shown in FIGS. 18 and 20, one of the recessed areas 110 about the periphery of cam plate 88 is positioned relative to microswitch 112 for the latter to open, thereby de-energizing motor 80 and leaving the drawer in the extended position. This position affords access to the coin tubes for the removal thereof from the drawer. During this period, push button switch 314 can be depressed to energize light 310 to illuminate the coin storage area of the drawer. When the coins have been removed and the coin tubes returned to the support therefor, push button switch 314 can be depressed to de-energize light 310 and push button switch 316 can be depressed to close the circuit to motor 80 through batteries 312 to initiate displacement of the drawer from the extended toward the retracted position thereof in response to rotation of cam plate 88 by the drive motor. Initial rotation of the cam plate brings one of the cam portions 108 thereof into engagement with microswitch 112 to close the latter, whereupon switch 316 can be released and motor 80 will continue to be in circuit with batteries 312 through microswitch 112. When the drawer reaches the retracted position, one of the recessed areas 110 about the periphery of the cam plate is positioned relative to microswitch 112 for the latter to open and thus open the circuit to motor 80. As the drawer reaches the retracted position thereof, switch finger 350 thereon engages and closes microswitch 348, thus enabling connection of sorting wheel drive motor 262 to batteries 312 through push button switch 314.

Figure 8:
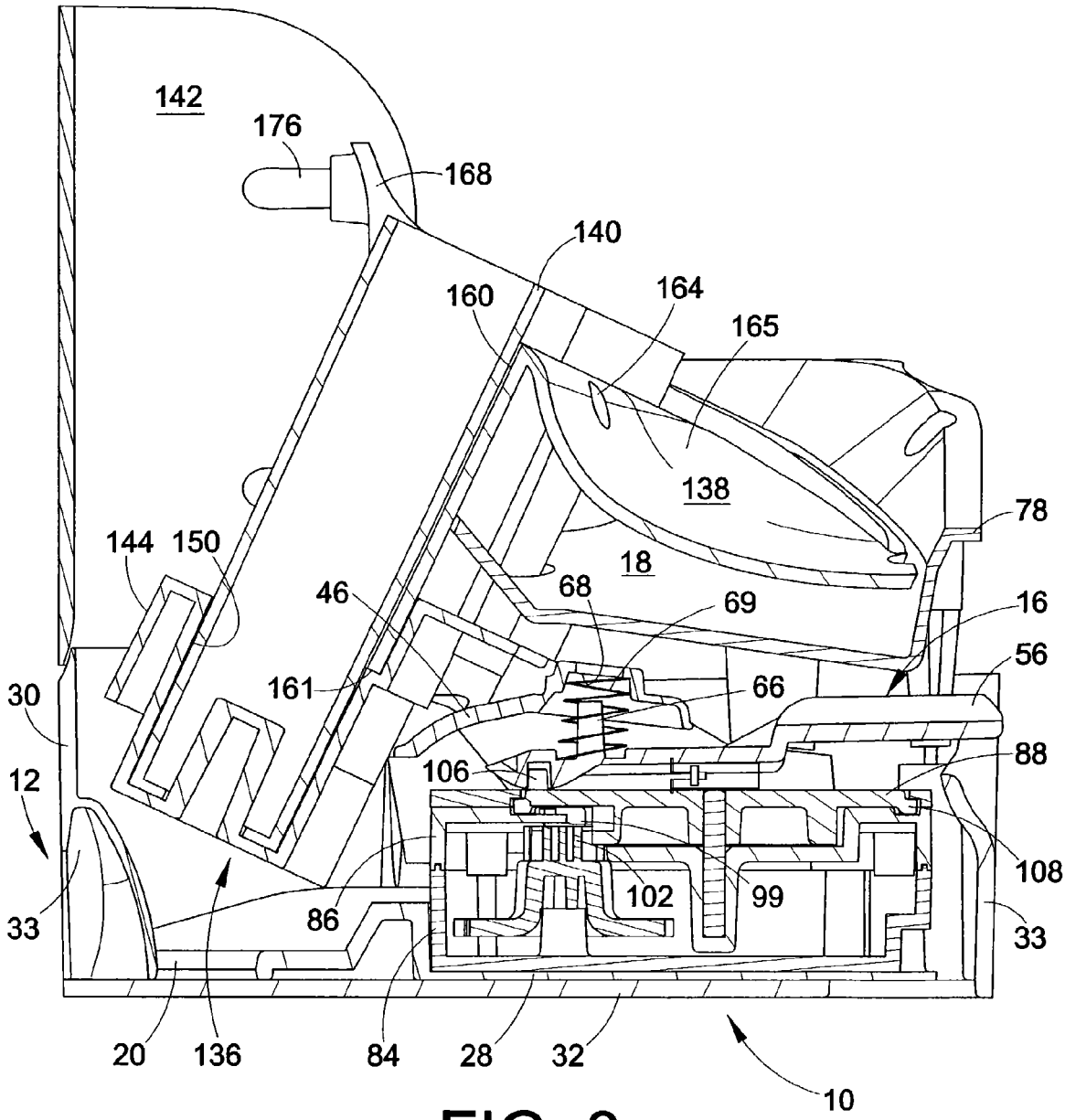
FIG. 8 is an enlarged side elevation view, in section, of the base and drawer unit, drawer drive unit, and coin storage tube unit of the coin bank and showing the drawer and coin storage tube unit in the retracted position thereof.
Figure 9:
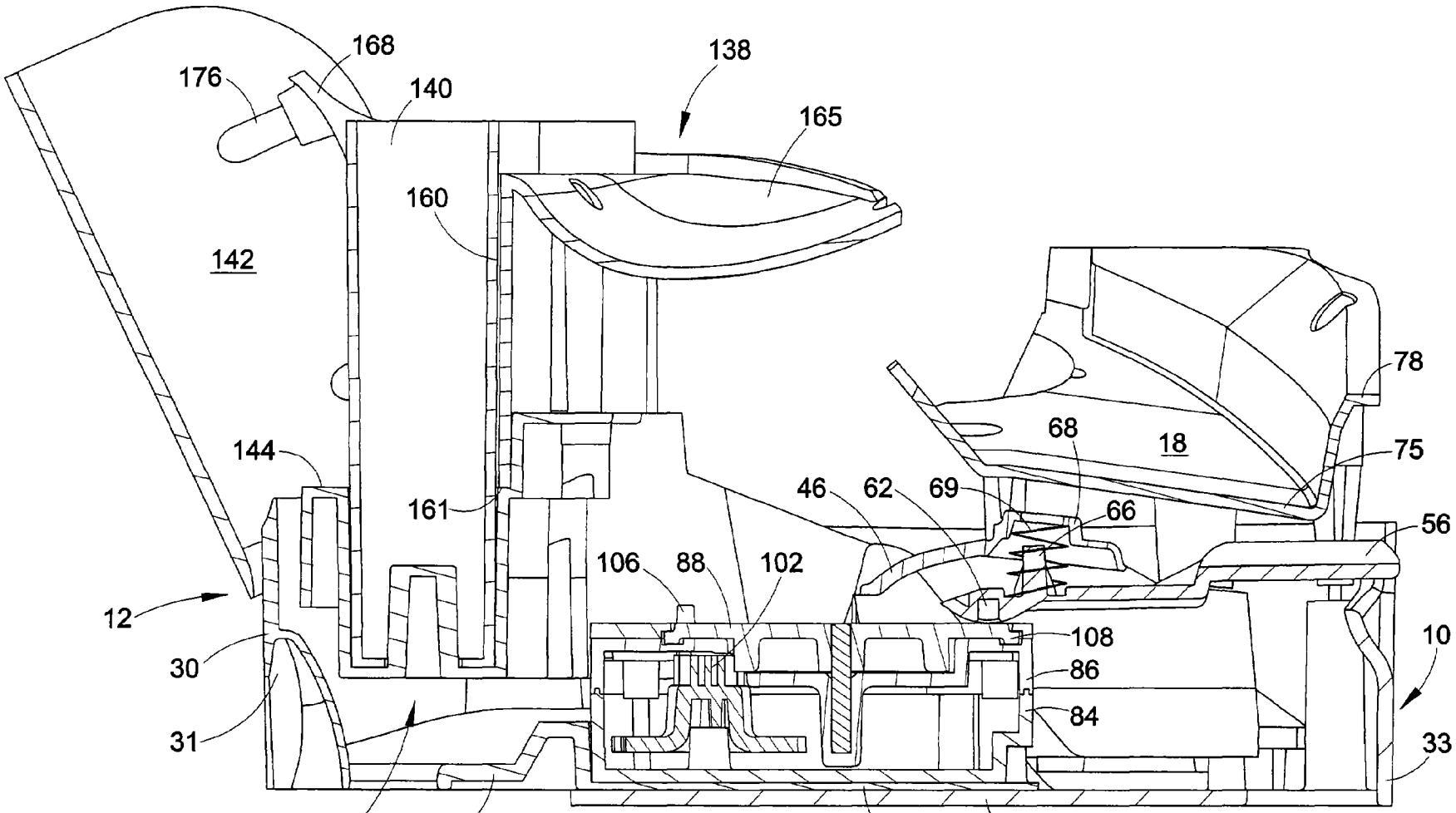
FIG. 9 is a side elevation view, in section, similar to FIG. 8 and showing the drawer and coin storage tube unit in the extended position thereof.
Figure 10:
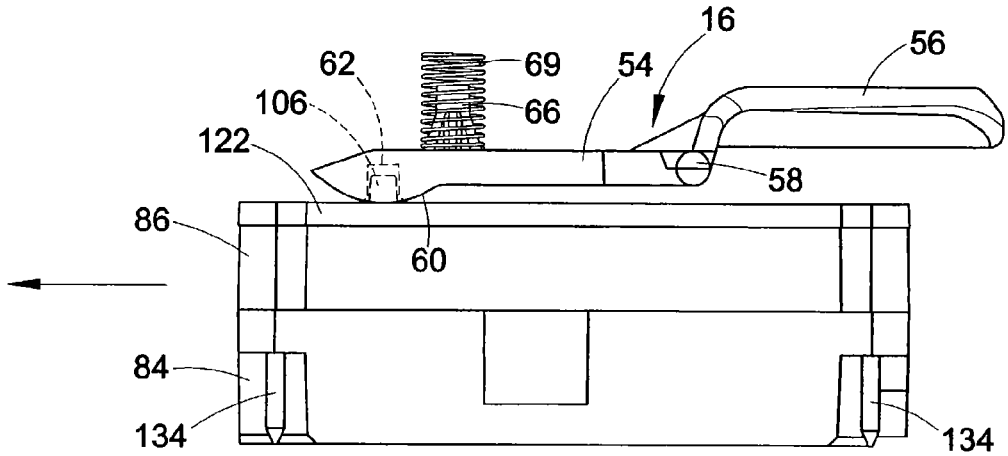
FIG. 10 is a side elevation view of the drawer drive unit and release lever and showing the cam pin and release lever in interengaged relationship.
Figure 11:
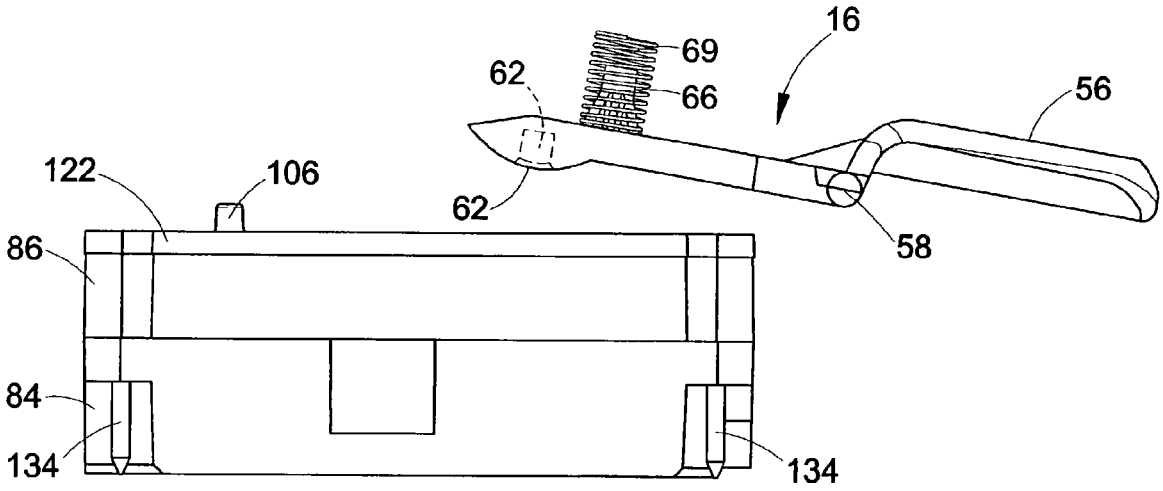
FIG. 11 is a side elevation view similar to FIG. 10 and showing the release lever disengaged from the cam pin and the drive unit displaced forwardly of the release lever.

When the drawer is in the retracted position thereof, it can be released for manual displacement to the extended position by depressing the rear end of arm 56 of lever 16, whereby the lever is pivoted clockwise from the position shown in FIGS. 8 and 10 to the position shown in FIG. 11 of the drawing. In the latter position, cam slot 62 is displaced upwardly from cam pin 106, whereby the drawer drive unit and thus drawer 12 are adapted to be manually displaced in the direction of the arrow in FIG. 10 to move the drawer, drive unit and coin tube assembly from the positions thereof in FIG. 8 to the positions thereof in FIG. 9, such displacement being achieved by engaging a finger in finger recess 31 (FIG. 7B) in the front wall of the drawer and pulling forwardly on the drawer. Once the drawer has been pulled forwardly sufficiently to separate cam pin 106 from the forward end of lever 16, the latter can be released, whereupon spring 66 biases the lever counterclockwise to engage cam plate 88, as shown in FIG. 9 of the drawing. When it is desired to close the drawer, the latter is pushed from left to right in FIG. 9 to the retracted position of the drawer shown in FIG. 8, and when the drawer approaches the retracted position, arcuate under side 106 of the lever is engaged by cam pin 106 and displaces the lever clockwise against the bias of spring 66 until the pin enters recess 62 in the lever.

While considerable emphasis has been placed herein on the structures and structural interrelationships between the component parts of a preferred embodiment of the invention, it will be appreciated that many changes can be made in the preferred embodiment and that other embodiments of the invention can be made without departing from the principles of the invention and which modifications and other embodiments will be obvious or suggested to others from the description herein.

While the disclosed embodiment of the displacement device is in the form of an electric motor, it should be appreciated that a semi-automatic opening device (that is one which is manually actuated but can open the drawer without further manual contact) according to the present invention can be designed in a variety of different forms. For example, the semiautomatic opening device can be a compression spring mounted between the housing and the drawer such that a push button releases a lock allowing the compression spring to urge the drawer outwardly in relation to the housing and away from its retracted position in the housing. With such a semi-automatic opening device, the drawer can be pushed back into its retracted position by exerting a manual force against the bias of the compression spring. The lock mechanism can be of a well-known type which simply clicks back into place once the drawer is fully retracted in order to hold the door in its retracted position until the lock mechanism is again tripped, thereby disengaging the lock mechanism so that the compression spring can urge the drawer outwardly in relation to the housing. It should be appreciated that one or more compression springs can be provided. Similarly, it should be appreciated that there are a variety of other known semi-automatic opening devices that can be employed to selectively displace the drawer from its retracted position to its extended position.

Accordingly, it is to be distinctly understood that the foregoing descriptive matter is to be interpreted merely as illustrative of the invention and not as a limitation. It is intended that the invention be construed as including all such modifications and alterations as come within the scope of the appended claims or the equivalents thereof.

Having thus described the invention, it is claimed as:

1. A coin bank comprising a housing having a coin receiving area, a coin sorting area, and a coin storage area for storing sorted coins, said storage area including a drawer displaceable relative to said housing between retracted and extended positions, and a semi-automatic opening device for displacing said drawer from said retracted position to said extended position.

2. The coin bank of claim 1, wherein said opening device includes an electric motor.

3. The coin bank of claim 2, further including a control circuit for operating said motor to sequentially extend and retract said drawer relative to said housing.

4. The coin bank of claim 3, wherein said control circuit includes a manually operable switch for initiating operation of said motor for displacement of said drawer from one of the retracted and extended positions toward the other, and a limit switch to de-energize the motor when the drawer reaches the other position.

5. The coin bank of claim 1, further including a release member for disabling said opening device, whereby said drawer is manually displaceable from said retracted position to said extended position.

6. A coin bank comprising a housing having a coin receiving area, a coin sorting area and a coin storage area for storing sorted coins, said coin storage area including a drawer movably mounted in said housing, a drive unit mounted on said drawer for displacement therewith, and a coupling between said drive unit and said housing and interengaging with said drive unit for operation thereof to displace said drawer between a retracted position and an extended position.

7. The coin bank of claim 6, wherein said coupling is selectively displaceable relative to said drive unit to release said drawer for manual displacement between the retracted and extended positions.

8. The coin bank of claim 6, wherein said drive unit includes a cam rotatably mounted on said drawer and interengaging with said coupling for rotation of the cam to displace the drawer.

9. The coin bank of claim 8, wherein said cam includes a pin and said coupling includes a slot receiving said pin.

10. The coin bank of claim 9, wherein said coupling is displaceable relative to said housing to disengage from said pin.

11. The coin bank of claim 10, wherein said coupling includes a lever pivotally mounted on said housing.

12. The coin bank of claim 6, wherein said drive unit includes a cam and an electric motor for driving the cam, said cam interengaging with said coupling for displacing said drawer between the retracted and extended positions when said motor is energized.

13. The coin bank of claim 12, further including a control circuit for said motor, said control circuit including a manually operable switch for initiating operation of the motor for displacement of the drawer between the retracted and extended positions thereof and a limit switch for de-energizing the motor in each of the retracted and extended positions of the drawer.

14. The coin bank of claim 13, wherein said cam includes a pin and said coupling includes a lever pivotally mounted on said housing for displacement between first and second positions relative to said pin, said lever having a slot receiving said pin in said first position, whereby rotation of said cam displaces said pin along said slot to displace the drawer relative to the housing, said lever in said second position disengaging said slot from said pin, whereby said drawer is manually displaceable relative to said housing.

15. A coin bank comprising, a housing having a coin receiving area, a coin sorting area, and a coin storage area for storing sorted coins, said storage area comprising a coin tube support displaceable between retracted and extended positions relative to said housing, a plurality of coin tubes selectively held on said coin tube support for holding sorted coins, and a semi-automatic opening device positioned between said housing and said coin tube support for selectively displacing said coin tube support from a retracted position to an extended position.

16. The coin bank of claim 15 wherein said opening device comprises a motor.

17. The coin bank of claim 16, wherein said opening device includes a cam mounted on one of said tube support and said housing and a cam track mounted on another of said tube support and said housing, said cam and said cam track interengaging for displacing said coin tube support between said retracted and extended positions in response to operation of said motor.

18. The coin bank of claim 15, wherein said coin tube support includes a bottom wall displaceable between said retracted and extended positions, a coin tube base mounted on said bottom wall for displacement therewith and for displacement relative thereto, said coin tubes being mounted on said tube base.

19. The coin bank of claim 15, further comprising a member on said housing for releasing said coin tube support for manual displacement between said retracted position and said extended position.

20. The coin bank comprising a housing having a coin receiving area, a coin sorting area and a coin storage area for storing sorted coins, a coin support for holding sorted coins and a drive mechanism for moving said coin support between retracted and extended positions in relation to said housing wherein said drive mechanism includes an electric motor and a control circuit for said electric motor including a control switch for initiating operation of said electric motor for displacement of said coin support from said retracted to said extended position.

21. The coin bank of claim 20 further comprising a limit switch for interrupting operation of said electric motor when said coin tube support reaches said extended position.

22. The coin bank of claim 20, wherein said control switch is operable in said extended position of said coin support to initiate operation of said electric motor for displacing said coin support from said extended position to said retracted position.

23. The coin bank of claim 20, wherein said drive mechanism includes a pin supported on said coin support for rotation about a vertical axis spaced from the pin, wherein said electric motor rotates the pin about said axis, and a release member on said housing having an elongate slot extending transverse to and slidably receiving said pin, whereby rotation of said pin about said axis displaces said coin tube support between said retracted and extended positions.

24. The coin bank of claim 23, wherein said release member includes a lever pivotally mounted on said housing for displacement relative thereto between engaged and released positions relative to said pin, said coin support in said released position of said lever being manually displaceable between said retracted and released positions.

25. The coin bank of claim 24 further comprising a spring biasing said lever toward the engaged position thereof, said pin slidably engaging said lever against the bias of said spring and moving into engagement with said slot in response to manual displacement of said coin support from said extended to said retracted position.

26. A coin bank comprising a housing having a coin receiving area, a coin sorting area and a coin storage area for storing sorted coins, said storage area comprising a coin tube support displaceable between retracted and extended positions relative to said housing and a drive mechanism for selectively displacing said coin tube support between said retracted and extended positions, wherein said drive mechanism includes an electric motor and a control circuit for said electric motor including a control switch for initiating operation of said electric motor for displacement of said coin tube support from said retracted to said extended position and from said extended to said retracted position and a limit switch to interrupt operation of said electric motor when said coin tube support reaches each of the retracted and extended positions thereof.

27. The coin bank of claim 26, wherein said coin tube support includes a bottom wall displaceable between said retracted and extended positions, a coin tube base mounted on said bottom wall for displacement therewith and for pivotal displacement relative thereto, said coin tube being on said coin tube base, a ramp mounted on said housing, and said coin tube base interengaging with said ramp for pivotally displacing said coin tube base between first and second angular positions relative to said bottom wall in response to movement of said bottom wall between said retracted and extended positions.

28. The coin bank of claim 27, further comprising a lever pivotally mounted to said base, and a spring biasing said lever toward one end position thereof.

29. The coin bank of claim 28, further comprising a pin operatively connected to said motor, said pin slidably engaging a slot of said lever, as biased by said spring.

30. The coin bank of claim 26, wherein said pin is located on a cam plate rotatable about an axis by said motor, said cam plate operating said limit switch to interrupt operation of said motor.

* * * * *